US008770259B2

(12) United States Patent
Kato et al.

(10) Patent No.: US 8,770,259 B2
(45) Date of Patent: Jul. 8, 2014

(54) APPARATUS FOR CAST-PRODUCT PRODUCTION LINE

(71) Applicants: Hiroaki Kato, Toyota (JP); Shinichi Tyomatsuken, Toyota (JP)

(72) Inventors: Hiroaki Kato, Toyota (JP); Shinichi Tyomatsuken, Toyota (JP)

(73) Assignee: Aisin Takaoka Co., Ltd., Toyota-shi (JP)

( * ) Notice: Subject to any disclaimer, the term of this patent is extended or adjusted under 35 U.S.C. 154(b) by 0 days.

(21) Appl. No.: 13/738,289

(22) Filed: Jan. 10, 2013

(65) Prior Publication Data

US 2013/0126118 A1 May 23, 2013

Related U.S. Application Data

(62) Division of application No. 12/441,465, filed as application No. PCT/JP2006/319632 on Sep. 25, 2006, now abandoned.

(51) Int. Cl.

| | |
|---|---|
| ***B22C 25/00*** | (2006.01) |
| ***B22C 9/00*** | (2006.01) |
| ***B22D 47/00*** | (2006.01) |
| ***B22D 29/00*** | (2006.01) |

(52) U.S. Cl.

USPC ..... 164/18; 164/15; 164/130; 164/131

(58) Field of Classification Search

USPC ..... 164/129–131, 15, 18

See application file for complete search history.

(56) References Cited

U.S. PATENT DOCUMENTS

| | | | |
|---|---|---|---|
| 4,141,404 | A | 2/1979 | McMullen |
| 4,534,401 | A | 8/1985 | Schaumburg et al. |
| 4,620,353 | A | 11/1986 | Pryor |
| 4,901,612 | A | 2/1990 | Harris |
| 5,816,312 | A | 10/1998 | Suginaka et al. |
| 6,672,367 | B2 | 1/2004 | Crafton et al. |
| 7,252,134 | B2 | 8/2007 | Crafton et al. |
| 2005/0072552 | A1 | 4/2005 | Itoh |

FOREIGN PATENT DOCUMENTS

| | | |
|---|---|---|
| JP | 60-018269 | 1/1985 |
| JP | 62-252660 | 11/1987 |
| JP | 63-317232 | 12/1988 |
| JP | 01-233059 | 9/1989 |
| JP | 09-164472 | 6/1997 |
| JP | 09-225624 | 9/1997 |
| JP | 2001-300718 | 10/2001 |
| JP | 2002-321051 | 11/2002 |
| JP | 2003-055731 | 2/2003 |
| JP | 2003 154438 | 5/2003 |
| JP | 2003-326358 | 11/2003 |
| JP | 2007-136539 | 6/2007 |

OTHER PUBLICATIONS

Machine Translation of JP 2007-136539.

*Primary Examiner* — Kevin P Kerns
*Assistant Examiner* — Steven Ha
(74) *Attorney, Agent, or Firm* — Oblon, Spivak, McClelland, Maier & Neustadt, L.L.P.

(57) ABSTRACT

An apparatus for cast-product production line includes a kneader for kneading casting sand for making mold; a mold maker for making a sand casting mold from the casting sand for making mold, the sand casting mold being provided with a molding cavity for forming a singular cast product or plural products; a molten-metal pourer for pouring molten metal into said molding cavity of the sand casting mold; and a mold disassembler for disassembling the sand casting mold having undergone molten-metal pouring. Upon disassembling the sand casting mold by the mold disassembler, the sand casting mold is disassembled in such a state that the cast product is supported by means of a cast-product supporter element.

18 Claims, 8 Drawing Sheets

APPARATUS FOR CAST-PRODUCT PRODUCTION LINE

CROSS REFERENCE

This application is a division of and is based upon and claims the benefit of priority under 35 U.S.C. §120 for U.S. Ser. No. 12/441,465, filed Mar. 16, 2009, the entire contents of which are incorporated herein by reference, which is a National Stage of PCT/JP06/319632, filed Sep. 25, 2006.

TECHNICAL FIELD

The present invention relates to an apparatus for cast-product production line for producing cast product.

BACKGROUND ART

Conventionally, a casting method, and a casting line have been disclosed, casting method and casting line in which a plurality of casting frames are put in place in series along a conveyor path that is formed as a closed circular loop shape (Patent Literature No. 1). In accordance with this one, a mold-making apparatus is put in place at the center of the conveyor path that is formed as a closed circular loop shape. Further, a molten-metal pouring apparatus, and a casting-mold disassembling apparatus are put in place in this order along the conveyor path that is formed as a closed circular loop shape. And, a sand casting mold, which has been made by means of the mold-making apparatus, is conveyed to the side of the molten-metal pouring apparatus along the conveyor path that is formed as a closed circular loop shape; is subjected to molten-metal pouring by means of the molten-metal pouring apparatus; is thereafter conveyed to the side of the casting-mold disassembling apparatus along the conveyor path that is formed as a closed circular loop shape; and is then disassembled by means of the casting-mold disassembling apparatus.

Moreover, a rotary-drum-type sand processing apparatus has been disclosed, rotary-drum-type sand processing apparatus which is provided with: a casting-mold disassembling device that possesses a rotary drum being put in place as a horizontal-shaft type and being formed as a long circular-cylinder configuration; a carry-in conveyor that is connected to the inlet opening of the rotary drum of the casting-mold disassembling device; and a carry-out conveyor that is connected to the outlet opening of the rotary drum of the casting-mold disassembling device (Patent Literature No. 2). In accordance with this one, in such a state that the sand casting mold, in which cast products are buried, is fitted into the inside of the rotary drum through the inlet opening, the rotary drum rotates. And, the cast products are rolled inside the rotary drum by means of rotation, and thereby the separation of the casting sand from the cast products is facilitated. Since the inlet opening is formed at an opposite end of the rotary drum, and since the outlet opening is formed at another end of the rotary drum, the cast products roll over the entire length of the rotary drum, and thereby the separation of the casting sand from the cast products is facilitated by means of rolling.

Furthermore, a sand collecting apparatus has been disclosed, sand collecting apparatus which has a casting-mold disassembling device that possesses a box-shaped decompressing container (Patent Literature No. 3). In accordance with this one, the entirety of the sand casting mold, which possesses cast products being formed by pouring molten metal, is accommodated inside the box-shaped decompressing container of the casting-mold disassembling device. In such a state, the inside of the decompressing container is decompressed by means of vacuum source, such as a vacuum pump, and thereby moisture in the moisture-condensed layer of the sand casting mold is vaporized, moisture-condensed layer which is present in the vicinity of the cast products. And, the sand casting mold is collapsed by utilizing pressure that is generated by means of boiling, and thereby the separation of the casting sand from the cast products is facilitated.

Patent Literature No. 1: Japanese Unexamined Patent Publication (KOKAI) Gazette No. 2003-326, 358;

Patent Literature No. 2: Japanese Unexamined Patent Publication (KOKAI) Gazette No. 9-225, 624; and Patent Literature No. 3: Japanese Unexamined Patent Publication (KOKAI) Gazette No. 2001-300, 718

In accordance with the aforementioned conventional art, the downsizing of casting-mold disassembling device (mold-disassembling unit) for disassembling sand casting mold, and the shortening of disassembling time have been requested. However, they have not necessarily been sufficient.

In Patent Literature No. 1, since the conveyor route is formed as a circular loop shape, dead spaces are likely to arise in the space that is surrounded by the circular loop, and thereby the downsizing has not necessarily been sufficient. Further, a long time has been necessary for the time for disassembling the sand casting mold.

In Patent Literature No. 2, since the rotary drum, which is formed as a long cylindrical configuration and which is put in place as a horizontal-shaft type, is used, the longer the length of the rotary drum in the axially longitudinal direction the longer the distance for rolling the cast products is secured inside the rotary drum, and thereby it is possible to separate the casting sand from the cast products. Therefore, the length of the rotary drum has tended to become longer in the axially longitudinal direction, and accordingly the casting-mold disassembling device has tended to jumbolize. Further, a longer time has been necessary for the time for disassembling the sand casting mold.

Moreover, in Patent Literature No. 3, since the box-shaped decompressing container that surrounds the entirety of the sand casting mold from the outside, and the vacuum source, such as a vacuum pump that is connected to the decompressing container, are used, the casting-mold disassembling device has tended to jumbolize. Furthermore, a longer time has been necessary for obtaining vacuum, and thereby a much longer time has been necessary for the time for disassembling the sand casting mold.

In addition, in accordance with aforementioned Patent Literature Nos. 1-3, since a longer time has been necessary for the disassembling time, the temperature of the cast products immediately after the disassembly has been cooled to low temperature considerably. Hence, they are not one which can execute controlled cooling that accelerates the cooling rate of the cast products after the disassembly.

DISCLOSURE OF THE INVENTION

The present invention has been done in view of the aforementioned circumstances; and accordingly it is an assignment to provide an apparatus for cast-product production line, apparatus which can separate cast product from casting sand quickly in a short period of time without ever using any jumbolized casting-mold disassembling device; which can therefore maintain the temperature of cast product after the disassembly in high-temperature state; in which controlled cooling that accelerates the cooling rate of cast product after disassembly becomes feasible; and which further makes it possible to intend the downsizing of mold-disassembling unit.

(1) An apparatus for cast-product production line according to a first aspect is an apparatus for cast-product production line that has the following jointly: a kneader for kneading casting sand for making mold; a mold maker for making a sand casting mold of the casting sand for making mold, the sand casting mold being provided with a molding cavity for forming a singular cast product or plural cast products; a molten-metal pourer for pouring molten metal into the molding cavity of the sand casting mold; and a mold disassembler for disassembling the sand casting mold having undergone molten-metal pouring and is characterized in that, upon disassembling the sand casting mold by the mold disassembler, it is adapted so that the sand casting mold is disassembled in such a state that at least a portion of the cast product is supported by means of a cast-product supporter element.

In accordance with the apparatus for cast-product production line according to the first aspect, the sand casting mold is disassembled in such a state that at least a portion of the cast product is supported by means of the cast-product supporter element. Accordingly, without ever using the jumbolized casting-mold disassembling devices according to the conventional art (Patent Literature Nos. 2 and 3), it is possible to disassemble the sand casting mold and then separate the cast product from the casting sand in a short period of time.

Further, in accordance with the present aspect, since it is allowable not to dispose the horizontal-shaft-type rotary drum and box-shaped decompressing container, it is possible to intend the downsizing of the mold disassembler, and eventually the downsizing of the apparatus for cast-product production line. Furthermore, since it is adapted so that the sand casting mold is disassembled in such a state that the cast product is supported by means of the cast-product supporter element, the time for disassembling the sand casting mold becomes short. In this case, it is possible to maintain the temperature of the cast product after disassembly at temperature as high as possible. Therefore, it is possible to accelerate the cooling rate of the cast product after disassembly, and thereby it is possible to execute controlled cooling for adjusting the texture of metallic structure. In accordance with controlled cooling, it becomes feasible to adjust the area proportions of metallic phases, such as perlite, ferrite and bainite, in the texture of the cast product. Concretely speaking, it becomes feasible to increase the area proportions of strengthened phases, such as perlite and bainite. Since the texture is thus strengthened, it is possible to expect to reduce alloying elements for strengthening, such as manganese, chromium and vanadium, while securing the strength of the cast product. Here, the "temperature of the cast product after disassembly" means the temperature of the cast product at the time when the aggregated sand casting mold has collapsed.

In accordance with the present aspect, as for the temperature of the cast product at the time of starting the mold disassembly, it can be temperature range beyond A1 transformation temperature, or it can be A1 transformation temperature, or it can be temperature range being less than A1 transformation temperature and 450° C. or more. The "A1 transformation temperature" means A1 transformation temperature at the time of temperature decrement. Note that it is preferable that the temperature of the cast product at the time of starting the mold disassembly can be 1,200° C. or less, 1,000° C. or less, 900° C. or less, or 800° C. or less, because there is a fear that the deformation of the cast product might become greater when it is high temperature too much. Moreover, when the temperature of the cast product at the time of starting the mold disassembly is low temperature too much, since no controlled cooling can be expected, it is preferable to be 450° C. or more, 500° C. or more, 550° C. or more, or 600° C. or more.

Further, as for the temperature of the cast product after disassembly, it can be temperature range beyond A1 transformation temperature, or it can be A1 transformation temperature, or it can be temperature range being less than A1 transformation temperature and 450° C. or more. Similarly, since there is a fear that the deformation of the cast product might become greater when the temperature of the cast product after disassembly is high temperature too much, it is preferable to be 1,100° C. or less, 1,000° C. or less, 900° C. or less, or 800° C. or less. Moreover, when the temperature of the cast products after the disassembly is low temperature too much, since no controlled cooling can be expected, it can be 450° C. or more, 500° C. or more, 550° C. or more, or 600° C. or more. Note that, at the instant of finishing the disassembly, it is allowable that the casting sand can even adhere to the cast product to such an extent that it can be easily removed with shots.

In accordance with the present aspect, it is possible to think of the following forms, (a)-(c), as controlled cooling:

(a) to accelerate the cooling rate that passes A1 transformation temperature from temperature region that is higher than the A1 transformation temperature;

(b) to accelerate the cooling rate that undergoes temperature decrement from temperature region that falls plus/minus 15° C. of A1 transformation temperature; and (c) to accelerate the cooling rate that undergoes temperature decrement from temperature region that is less than A1 transformation temperature and 450° C. or more.

(2) An apparatus for cast-product production line according to a second aspect is characterized in that, in the aforementioned aspect, it is adapted so that: (i) the mold disassembler possesses a separator for taking out the cast product from out of the sand casting mold, and additionally for separating the casting sand of the sand casting mold, casting sand to which thermal influence resulting from the molten metal is great relatively, from the casting sand thereof, casting sand to which thermal influence resulting from the molten metal is small relatively; (ii) the kneader is equipped with (ii-a) a first kneader, and (ii-b) a second kneader, the first kneader being for blending and then kneading an additive material for sand with the casting sand, which has been separated by the separator and to which the thermal influence is great relatively, them, thereby recovering the casting sand, the second kneader being for blending and then kneading the casting sand, which has been kneaded and then recovered by the first kneader, with the casting sand, which has been separated by the separator and to which the thermal influence is small relatively, thereby forming the casting sand for making mold, casting sand which is to be subjected to the mold making by the mold maker; (iii) when a blending amount of the additive material for sand, additive material which is blended with per unit mass of the casting sand to which the thermal influence is great relatively, is taken as "Wa" and a blending amount of the additive material for sand, additive material which is blended with per unit mass of the casting sand to which the thermal influence is small relatively, is taken as "Wb," the blending amount "Wa" is set greater than the blending amount "Wb"; and (iv) the casting sand for making mold, casting sand which has been formed by the second kneader, is conveyed to the mold maker.

In this case, the separator of the mold disassembler fractionates the casting sand to which the thermal influence is great relatively from the casting sand to which is the thermal influence is small relatively. And, when a blending amount of the additive material for sand to be blended with the casting sand to which the thermal influence is great relatively (per unit mass of the casting sand) is taken as "Wa" and a blending amount of the additive material for sand to be blended with the casting sand to which the thermal influence is small relatively (per unit mass of the casting sand) is taken as "Wb," "Wa" is set greater than "Wb." In other words, a major emphasis is put on the casting sand to which the thermal influence is great relatively, and accordingly the additive material for sand is blended emphatically with the casting sand to which the thermal influence is great relatively. Moreover, with the casting sand to which the thermal influence is small relatively, the additive material for sand is blended not that much, or is not blended at all. Accordingly, while maintaining the qualities of the casting sand for making mold, it is possible to reduce the consumption amount of the additive agent for sand, additive agent which is to be blended with the casting sand, as much as possible. Moreover, the present aspect is adapted so that the casting sand for making mold, casting sand which has been formed by the second kneader, is conveyed to the mold maker. Consequently, the casting sand for making mold, casting sand which has been formed by the second kneader, is supplied to the mold maker directly. Hence, the keeper space for keeping the casting sand for making mold can be made smaller, and thereby the downsizing of the apparatus for cast-product production line can be intended.

(3) In accordance with an apparatus for cast-product production line according to a third aspect, it is provided with: (i) the cast-product supporter element for restraining at least a portion of the cast product, which is buried in the sand casting mold that is after molten-metal pouring, thereby supporting the portion at least; (ii) a tearer for tearing off an outside part of the sand casting mold, which is after molten-metal pouring and buries the cast product therein, from the cast product partially; and (iii) a tear-off driving source for moving the tearer in a tearing-off direction, in the aforementioned present aspect.

In this case, the tearer is driven by means of the tear-off driving source. As a result, an outside part of the sand casting mold, which is after molten-metal pouring and buries the cast product therein, is torn off from the cast products in a short period of time. Accordingly, the present aspect can make the temperature of the cast product after disassembly high temperature as much as possible. Consequently, controlled cooling for accelerating the cooling rate of the cast product after disassembly becomes feasible. In this case, since the cooling rate of the cast product accelerates, the texture of metallic structure becomes adjustable. As for the aforementioned tear-off driving source, fluidic-pressure cylinder devices (hydraulic-pressure cylinder devices and pneumatic-pressure cylinder devices, for instance), and motor devices can be exemplified. Here, as the tearer, a form can be exemplified, form which is provided with a first tearer, and a second tearer, which are capable of moving in a direction of getting away from each other. Further, as the tear-off driving source, a form can be exemplified, form which is provided with a first tear-off driving source, and a second tear-off driving source, the first tear-off driving source being for moving the first tearer in a direction for tearing off the sand casting mold, the second tear-off driving source being for moving the second tearer in a direction for tearing off the sand casting mold.

(4) In accordance with an apparatus for cast-product production line according to a fourth aspect, the mold disassembler has a crack generator to be pressed into the sand casting mold, which is after molten-metal pouring and buries the cast product therein, prior to the disassembling of the sand casting mold, thereby generating crack in the sand casting molding, in the aforementioned present aspect. In this case, since the crack generator generates crack in the sand casting mold, the sand casting mold becomes tearable early on. Hence, the operation for tearing off the sand casting mold can be quickened. Therefore, at the time of mold disassembly, since the casting sand around the cast product is removed early on while the decline of the temperature of the cast product after disassembly is being suppressed, the temperature of the cast product after disassembly is maintained at high temperature, and thereby controlled cooling for the cast product becomes easy.

(5) An apparatus for cast-product production line according to a fifth aspect is equipped with (i) a cutting-resistance detector for detecting cutting resistance at a time of cut processing the cast product by the cutter; and (ii) an adjustment commander for outputting a command for adjusting at least one of an amount of additive material for molten metal to be added to the meltable material and a type of the additive material for molten metal when abnormality is acknowledged in the cutting resistance being detected by the cutting-resistance detector, in the aforementioned present aspect. In this case, when abnormality is acknowledged in cutting resistance, at least one of an amount of additive material for molten metal to be added to the meltable material and a type of the additive material for molten metal is adjusted. Accordingly, the properties of the molten metal are adjusted, and thereby the abnormality of the cutting resistance is improved. Thus, it is possible to carry out the cut processing of the cast product favorably.

(6) An apparatus for cast-product production line according to a sixth aspect is equipped with (i) a dimensional-accuracy detector for detecting dimensional accuracy of the cast product before cutting and/or after cutting; and (ii) a casting-mold-strength adjustment commander for outputting a command for adjusting casting-mold strength of the sand casting mold to the mold maker when abnormality is acknowledged in the dimensional accuracy being detected by the dimensional-accuracy detector, in the aforementioned present aspect. In this case, since casting-mold strength of the sand casting mold is adjusted when abnormality is acknowledged in dimensional accuracy of the cast product, abnormality of dimensional accuracy in the cast product is improved.

(7) An apparatus for cast-product production line according to a seventh aspect is characterized in that it is equipped with (i) a shots-projecting device for projecting shots onto the product, which has been taken out from out of the sand casting mold, thereby dropping sand down therefrom; and (ii) a shot alteration commander for outputting a command for altering projection time of the shots to be projected and/or projection amount thereof to the shotting device depending on properties of the cast product, in the aforementioned present aspect. In this case, even when the cast product's material qualities, types, or the like, are altered, adequate shots are projected onto the cast product, and thereby all or most of the casing sand that adheres to the cast product is removed.

Moreover, when the temperature of the cast product is high temperature as aforementioned, shots come to be projected onto the high-temperature cast product. In this case, since the temperature of the cast product immediately after projecting shots is maintained high, the rate of cooling the cast product accelerates. Accordingly, controlled cooling for adjusting the texture of metallic structure becomes easy furthermore.

(8) An apparatus for cast-product production line according to an eighth aspect is characterized in that it is equipped with (i) a cast-product keeper for temporarily keeping the cast product, which has been taken out from out of the sand casting mold; and (ii) a cast-product cooling device for facilitating cooling of the cast product, which is cooled in the cast-product keeper and which is before cutting, in the aforementioned present aspect. In this case, when a number of the cast products, which are kept by the cast-product keeper and which are before cutting, or when the temperature of the cast products is higher than suitable temperature, since the cooling capacity of the cast-product cooling device is enhanced, the cooling of the cast products is facilitated. Hence, the increment of the number of intermediate stocks (cast products that are after disassembly and before cut processing) is suppressed.

(9) An apparatus for cast-product production line according to a ninth aspect is equipped with a cast-product cooling adjustment commander for outputting a command for adjusting cooling rate of the cast product before cutting to the cast-product cooling device depending on a kept number and/or temperature of the cast products, which are kept by the cast-product keeper, in the aforementioned present aspect. In this case, it is possible to adjust the cooling rate of the cast products, which are before cutting, depending on a kept number and/or temperature of the cast products. That is, when a kept number of the cast products increases, or when the temperature of the cast products is higher than a predetermined temperature, if the cooling rate of the cast products is accelerated, controlled cooling becomes much easier, and additionally the keeping space in the cast-product keeper is reduced.

Common Effect of the Invention

In accordance with the present invention, upon disassembling a sand casting mold by a mold disassembler, the sand casting mold is disassembled in such a state that a cast product is supported by means of a cast-product supporter element as aforementioned. Thus, it is possible to separate the cast product from casting sand easily and quickly. Therefore, the temperature of the cast product after disassembly can be maintained in high-temperature state as much as possible. Hence, controlled cooling for accelerating the cooling rate of the cast product after disassembly becomes feasible, and thereby it is possible to contribute to strengthening of the texture of the cast product's metallic structure. Further, in accordance with the present invention, since the sand casting mold is disassembled in such a state that cast product is supported by means of the cast-product supporter element, it is possible to intend to downsize the mold disassembler because it is allowable not to ever dispose the horizontal-shaft-type rotary drum and box-shaped decompressing container, contrary to the conventional art.

BRIEF DESCRIPTION OF THE DRAWINGS

FIG. 6 (B) is a cross-sectional view for illustrating the state of mold disassembling the sand casting mold, which has a cast product therein, by means of the mold disassembler schematically.

BEST MODE FOR CARRYING OUT THE INVENTION

Figure 1:
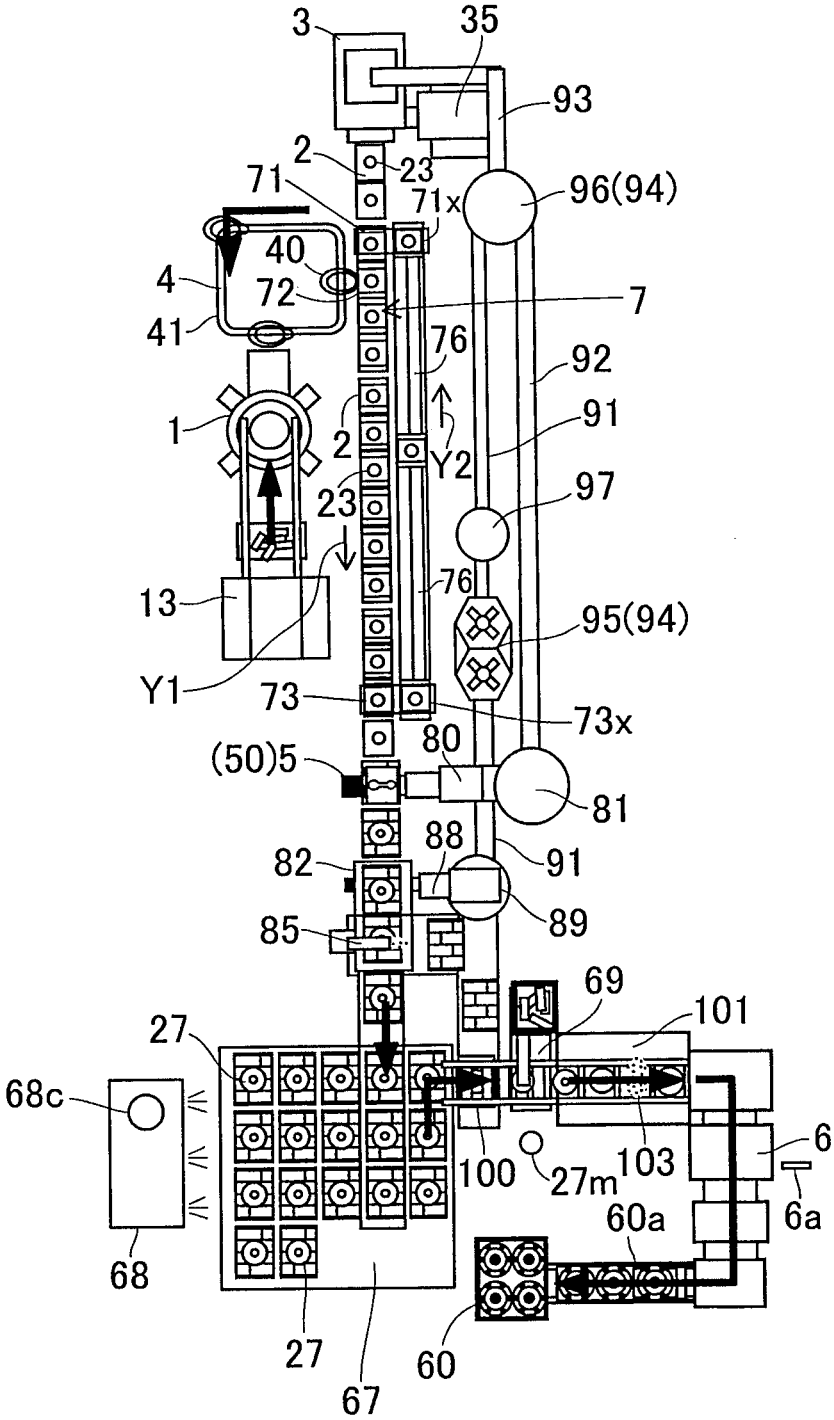
FIG. 1 is directed to Embodiment No. 1, and is a plan view for illustrating an apparatus for cast-product production line schematically.

An apparatus for cast-product production line has: a kneader for kneading casting sand for making mold; a mold maker for making a sand casting mold of the casting sand for making mold, the sand casting mold being provided with a molding cavity for forming a singular cast product or plural cast products; a molten-metal pourer for pouring molten metal into the molding cavity of the sand casting mold; and a mold disassembler for disassembling the sand casting mold having undergone molten-metal pouring. It is preferable that this apparatus for cast-product production line can further have a melter for forming molten metal by melting a meltable material, or a cutter for cut processing the cast product that has been disassembled from (or has been taken out from out of) the sand casting mold.

Upon disassembling the sand casting mold by the mold disassembler, it is adapted so that the sand casting mold is disassembled in such a state that the cast product is supported by means of a cast-product supporter element. As for the cast-product supporter element, it can be those which can support at least a portion of the cast product within the mold disassembler. As for at least a portion of the cast product, it can be either proper product parts of the cast product, or can be parts other than the proper product parts. As for the parts other than the proper product parts, at least one of the following is named: sprue-port part that is made of molten metal solidifying at sprue-port hollow in sand casting mold; a spure-runner part that is made of molten metal solidifying at spure-runner hollow in sand casting mold; a gate part that is made of molten metal solidifying at gate hollow in sand casting mold; gas-venting portion that is made of molten metal solidifying at vent hollow having gas-venting function in sand casting mold, and the like. When the parts other than the proper product parts are supported by the cast-product supporter element, damages to the proper product parts of the cast product are suppressed or avoided. As for a form for supporting the cast product by means of the cast-product supporter element, the following are exemplified: forms that fit into at least a portion of the cast product; or forms that lock mechanically with at least a portion of the cast product; or forms that hold at least a portion of the cast product therebetween, thereby fixing it.

As for the said melter, although it can be anything as far as it is those for forming molten metal by melting a meltable material, systems that melt it by supplying oxygen or oxygen-containing gas to fuel. Other than the systems, it is even allowable to use cupola, electric melting furnace, and the like. As for the fuel, it is not limited in particular, and solid fuel, liquid fuel, or gas fuel is exemplified. As for the molten metal, it can be molten metal of flaky graphite cast iron, molten metal of spheroidal graphite cast iron, molten metal of hypoeutectic cast iron, molten metal of hypereutectic cast iron, molten metal of eutectic cast iron, or molten metal of alloy cast iron, or it is allowable to be molten metal of other cast irons. As for the sand casting mold, it is preferable that it can have a molding cavity for casting a singular cast product. In this case, since the position of the cast product is immobilized within the sand casting mold, fluctuations in the dimensional accuracy, solidifying rate and after-solidification cooling rate of the cast product are reduced, and thereby fluctuations of the cast product's qualities are reduced. Note that, as for the sand casting mold that is made by the mold maker, it can be either frameless types, or framed types.

In accordance with the present invention, as for the mold disassembler, a form that possesses a separator is exemplified. The separator separates the casting sand of the sand casting mold, casting sand to which thermal influence resulting from the molten metal is great relatively, from the casting sand thereof, casting sand to which thermal influence resulting from the molten metal is small relatively. In this case, it is possible to emphatically blend an additive material for sand with the casting sand to which the thermal influence resulting from the molten metal is great relatively (or thermally degraded casting sand). It is adapted so that the additive material for sand is not at all blended with the casting sand to which the thermal influence resulting from the molten metal is small relatively, or is blended therewith in a small amount if being blended. As for the additive material for sand, those having been known heretofore, such as bonding agent like bentonite, are exemplified. As for the aforementioned mold disassembler, it is preferable that it can have a cast-product supporter element for supporting the cast product that is buried in the sand casting mold, and a separator for separating a section of the sand casting mold, which neighbors and is in proximity to the cast product, from the other section (section that does not neighbor and is not in proximity to the cast product). Thus, the separator can simply and easily separate the casting sand to which the thermal influence resulting from the molten metal is great relatively from the casting sand to which the thermal influence resulting from the molten metal is small relatively.

Therefore, as for the kneader, it can be provided with a first kneader, and a second kneader. The first kneader blends an additive material with the casting sand, which has been separated by the separator and to which the thermal influence is great relatively, and then kneads them, thereby recovering the casting sand. Thus, the properties of the casting sand to which the thermal influence is great relatively are improved. The second kneader blends the casting sand, which has been kneaded and then recovered by the first kneader, with the casting sand, which has been separated by the separator and to which the thermal influence is small relatively, and then kneads them, thereby forming the casting sand for making mold, which is to be subjected to the mold making by the mold maker. In this case, the first kneader blends an additive material for sand with the casting sand to which the thermal influence is great relatively, and then kneads them. It is possible to make the additive material for sand that is added at the second kneader a small amount or zero. Since an additive material for sand is thus blended emphatically with the casting sand to which the thermal influence is great relatively, it is possible to make the consumption amount of the additive material for sand slightly less while maintaining the stability of the cast product's qualities, and thereby it is possible to contribute to cost reduction.

As for the mold disassembler, a form is exemplified, form in which it starts and/or finishes the mold disassembling of the sand casting mold when a temperature of the cast product is A1 transformation temperature or more. In this case, it is possible to carry out controlled cooling taking A1 transformation temperature as a standard. Moreover, as the mold disassembler, a form is exemplified, form in which it starts and/or finishes the mold disassembling of the sand casting mold when a temperature of the cast product is less than A1 transformation temperature. In this case, it is possible to carry out controlled cooling of the cast product from temperature region that is less than A1 transformation temperature. When the temperature of the cast product is less than A1 transformation temperature, it can be high temperature as much as possible for the sake of controlled cooling.

In accordance with the present invention, a form is exemplified, form which has a cutter, the cutter being for cut processing the cast product that has been disassembled from (or has been taken out from out of) the sand casting mold. In this case, since a cutter comes to be incorporated into the apparatus for cast-product production line, without ever conveying the cast product that has been disassembled from (or has been taken out from out of) the sand casting mold to another cut processing line, it becomes feasible to cut process the cast product by the cutter of the apparatus for cast-product production line, it is possible to intend the downsizing of cutter in comparison with another cut processing line, and eventually it is possible to intend the downsizing of the apparatus for cast-product production line, apparatus which has the aforesaid cutter. Moreover, in the case where the apparatus for cast-product production line according to the present invention has the following jointly: the melter; the kneader; the mold maker; the molten-metal pourer; the mold disassembler; and the cutter, it is possible to carry out the following continuously by a single production line; from the melting of meltable material; the mold making of sand casting mold; the mold disassembling after molten-metal pouring; and up to the cut processing of cast product after mold disassembly.

In accordance with the present invention, a form is exemplified, form which is provided with a cutting-resistance detector for detecting cutting resistance at a time of cut processing the cast product by the cutter; and an adjustment commander for outputting a command for adjusting at least one of an amount of additive material for molten metal to be added to the meltable material and a type of the additive material for molten metal when abnormality is acknowledged in the cutting resistance being detected by the cutting-resistance detector.

Here, as for "when abnormality is acknowledged in the cutting resistance being detected by the cutting-resistance detector," such a case is named that chill generates in the cut part of cast product. In general, since chill is hard, it is presumed that chill generates in cast product when the cutting resistance of cast product is excessive.

When abnormality is acknowledged in the cutting resistance upon cut processing the cast product by the cutter as aforementioned, the adjustment commander outputs a command for adjusting at least one of an amount of additive material for molten metal to be added to the meltable material and a type of the additive material for molten metal. Thus, chill in the cast product is suppressed. As for the additive material for molten metal, carbon-based material, silicon-based material, or the like, is named. When increasing an amount of carbon-based material (graphite, and so forth, for instance) or silicon-based material (ferrosilicon, and so on, for instance), chill is suppressed because the carbon equivalent weight of molten metal increases.

In accordance with the present invention, a form is exemplified, form which is provided with. Thus, the dimensional accuracy of the cast product upgrades a dimensional-accuracy detector for detecting dimensional accuracy of the cast product before cutting and/or after cutting; and a casting-mold-strength adjustment commander for outputting a command for adjusting casting-mold strength of the sand casting mold to the mold maker when abnormality is acknowledged in the dimensional accuracy being detected by the dimensional-accuracy detector.

In accordance with the present invention, a form is exemplified, form which is provided with a shots-projecting device for projecting shots onto said product, which has been taken out from out of said sand casting mold, thereby dropping sand down therefrom; and a shots alteration commander for outputting a command for altering shotting condition of the shots to be projected depending on properties of the cast product. In this case, it can be adapted into a form that alters projection time and/or projection amount of the shots for every time the cast product is altered, for instance. Thus, it is possible to project suitable shots, depending on the cast product's properties.

Moreover, in accordance with the present invention, a form is exemplified, form which is provided with a cutting-resistance detector for detecting cutting resistance at a time of cut processing the cast product by the cutter, and an adjustment commander for outputting a command for adjusting grinding-off power of shots to be projected onto the cast product to the shots-projecting device when abnormality is acknowledged in the cutting resistance being detected by the cutting-resistance detector.

Moreover, in accordance with the present invention, a form is exemplified, form in which a cast-product keeper for temporarily keeping the cast product, which has been taken out from out of the sand casting mold; and a cast-product cooling device for facilitating cooling of the cast product, which is cooled in the cast-product keeper and which is before cutting are disposed. As for the cast-product cooling device, a form is exemplified, form in which cooling medium comprising at least one of air for cooling, spray for cooling and coolant water is brought into contact with the cast product. In addition, a form is exemplified, form which is provided with a cast-product cooling adjustment commander for outputting a command for adjusting cooling rate of the cast product before cutting to the cast-product cooling device depending on a kept number and/or temperature of the cast products, which are kept by the cast-product keeper. That is, when the a kept number of the cast products that are stored by the cast-product keeper increases, or when the temperature of the cast products is higher than a predetermined temperature, the cast-product cooling adjustment commander can output a command for accelerating the cooling rate of the cast products.

Embodiment No. 1

Hereinafter, Embodiment No. 1 according to the present invention will be explained with reference to FIG. 1 through FIG. 6. FIG. 1 illustrates a plan view of an apparatus for cast-product production line, apparatus which is directed to Embodiment No. 1. As shown in FIG. 1, the apparatus for cast-product production line has the following jointly: a melter 1 for forming cast-iron-based molten metal by melting a meltable material; a mold maker 3 for making a sand casting mold 2 of casting sand for making mold, sand casting mold 2 which is provided with a molding cavity 23 (see FIG. 2 and FIG. 3) for forming a singular cast product 27; a molten-metal pourer 4 for pouring the molten metal into the molding cavity 23 of the sand casting mold 2; a mold disassembler 5 for disassembling the casting mold 2 that has undergone molten-metal pouring; and a cutter 6 for cut processing the cast product 27 that has been disassembled from the sand casting mold 2.

Explanations will be added further. The melter 1 is adapted into a system in which a meltable material is melted by supplying oxygen or oxygen-containing gas to fuel. Those with this system can be downsized compared with cupola. In accordance with this melter 1, the melting efficiency is high, and thereby the reduction of fuel cost becomes feasible. As for the fuel at the melter 1, it can be either solid fuel, liquid fuel, or gas fuel. A material charger 13 for charging the meltable material into the melter 1 is disposed.

Figure 2:
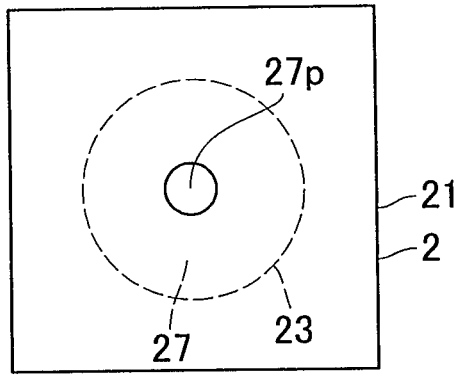
FIG. 2 is a plan view for illustrating a sand casting mold schematically.
Figure 3:
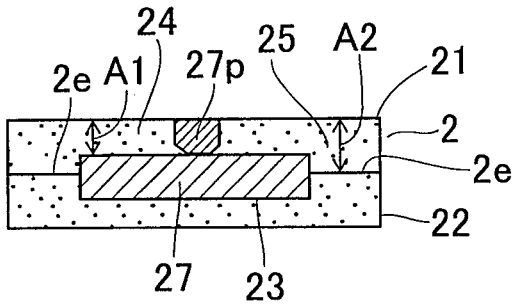
FIG. 3 is a cross-sectional view for illustrating the sand casting mold schematically.

The mold maker 3 makes the frameless sand casting mold 2, which is provided with the molding cavity 23 for forming the singular cast product 27. Note that, since the sand casting mold 2 for forming the singular cast product 27 can be made smaller than a sand casting mold for a plurality of the cast products 27 is, it is possible to intend the downsizing of the apparatus for cast-product production line. When being frameless type, since cast frame is abolished, it is possible to reduce cost in comparison with framed type, and additionally it is possible to intend the downsizing of the mold maker 3 (mold-making facilities and the incidental facilities). Further, when being frameless type, since the attaching/removing time for frame is abolished, it is possible to enhance the mold-disassembling rate of the sand casting mold 2, and thereby it is possible to contribute to controlled cooling. As illustrated in FIG. 2 and FIG. 3, the sand casting mold 2 is a horizontally splitable mold whose parting surfaces 2*e* are made horizontal, and is formed of a first sand casting mold 21 (upper mold) and a second sand casting mold 22 (lower mold). The molding cavity 23 for molding the singular cast product 27 is formed in the central area. The cast product 27, which is buried in the sand casting mold 2, possesses a sprue port 27*p* (section other than proper product part of the cast product 27), i.e., a section that is made by molten metal solidifying at the sprue-port hollow in the sand casting mold 2. As illustrated in FIG. 2, the sprue port 27*p* is put in position in the central region in the projection drawing of the cast product 27. Accordingly, it is possible to equalize thermal influence that the sprue port 27*p* gives to the cast product 27, and thereby it is possible to contribute to the reduction of fluctuation in the qualities and dimensional accuracy of the cast product 27.

As illustrated in FIG. 3, in the first sand casting mold 21, let a thickness of a first casting-mold part 24 that demarcates the molding cavity 23 be "A1," and let a thickness of a second casting-mold part 25 that does not demarcate the molding cavity 23 be "A2." Further, though not being shown diagrammatically, let a casting-sand charged thickness of the first casting-mold part 24 be "B1" (not shown), and let a casting-sand charged thickness of the second casting-mold part 25 be "B2" (not shown). In accordance with the present embodiment, let "A1"/B1" be "α1," and let "A2"/B2" be "α2," they are set within a range of "α1"/"α2"=0.8-1.2, or within a range of 0.9-1.1, in the first sand casting mold 21. Regarding the second sand casting mold 22 as well, they are made similarly.

As a result, when making molds, the casting-sand compression rates at the respective parts in the sand casting mold 2 are made uniform. Eventually, it is possible to reduce fluctuation of the casting-mold strength at the respective parts of the sand casting mold 2. In this case, it is possible to contribute to uniformizing the dimensional accuracy of the cast product 27. Suppose if, in the case where fluctuation of the casting-mold strength is great at the respective parts of the sand casting mold 2, since some of the molten metal for the cast product 27 expands out locally toward parts whose casting-mold strengths are low, there is a fear that the dimensional accuracy of the cast product 27 might decline locally.

As illustrated in FIG. 1, in the vicinity of the mold maker 3, a core-mold maker 35 is disposed, core-mold maker 35 which is for making a core mold that is to be attached to the sand casting mold 2. The sand casting mold 2, which has been made by means of the mold maker 3, migrates in the arrowed "Y1" direction along a casting-mold conveyor line 7 from the upstream side to the downstream side of this. In the casting-mold conveyor line 7, across this from the upper reaches to the lower reaches, a weight-loading position 71, a molten-metal-pouring position 72, and a weight-unloading position 73 are put in position in this order. When the sand casting mold 2, which is conveyed by means of the casting-mold conveyor line 7, arrives at the weight-loading position 71, a weight is loaded onto the top surface of the sand casting mold 2 by means of a weight-loading device 71*x*.

The molten-metal pourer 4 possesses a ladle 40 for retaining molten metal, and a guide rail 41 for guiding the ladle 40. When the sand casting mold 2 with the weight loaded arrives at the molten-metal-pouring position 72, the ladle 40 moves to incline, and thereby molten metal is poured into the molding cavity 23 of the sand casting mold 2 from the ladle 40. In this case, since it is allowable that the ladle 40 can retain the molten metal in such a volume to be poured into the molding cavity 23 for forming the singular cast product 27, it is possible to intend the downsizing of the ladle 40, and eventually the downsizing of the molten-metal pourer 4.

As described above, the sand casting mold 2 has the cavity 23 for casting the singular cast product 27. In this case, the position of the cast product 27 in the one-piece sand casting mold 2 becomes a constant position, and thereby the position of the cast product 27 is immobilized in the sand casting mold 2. Accordingly, fluctuation of the dimensions of the cast product 27, fluctuation of the solidifying rate and fluctuation of the after-solidification cooling rate are suppressed, fluctuations which are caused by positional alteration of the cast product 27 in the sand casting mold 2. The cast product 27 can be spheroidal graphite cast iron, flaky graphite cast iron or caterpillar-shaped graphite cast iron, or can be alloy cast steel depending on circumstances.

Suppose if, in the case where a plurality of the cast products 27 are cast by one set of the sand casting molds 2, the positions of the respective cast products 27 in the sand casting molds 2 do not become a constant position. Therefore, one of the cast products 27 might be positioned on the end side of the sand casting molds 2, or the other one of the cast products 27 might be poisoned on the central side of the sand casting molds 2. In this case, there is a fear that uniformity of the dimensional accuracy, solidifying rate, after-solidification cooling rate, and the like, in the respective cast products 27 might degrade. In this case, fluctuations in the dimensional accuracy, structure and strength for each of the cast products 27 tend to increase. As for the fluctuations, the following are named: fluctuations in perlite proportion, ferrite proportion, graphite size, graphite form, and so forth, in the texture of the cast products 27.

With this issue, in accordance with the present embodiment, the sand casting mold 2, which is made by means of the mold maker 3, has the cavity 23 for casting the singular cast product 27. That is, as illustrated in FIG. 2 and FIG. 3, the cavity 23 for casting the singular cast product 27 is always put in position in the central area of the sand casting mold 2, and thereby the cast product 27 comes to be put in place in the central area of the sand casting mold 2 at all times. Accordingly, even when a large number of the cast products 27 are cast, the positions of the respective cast products 27 in the sand casting molds 2 become a constant position. Hence, the uniformity of the dimensional accuracy, solidifying rate, after-solidification cooling rate, and the like, in the respective cast products 27 is secured; the fluctuations between the cast products 27 are reduced, fluctuations which are caused by the positional shift in the sand casting molds 2; and thereby it is possible to contribute to stabilizing the qualities of the cast products 27.

As illustrated in FIG. 1, at the upstream weight-unloading position 73 of the mold disassembler 5, a weight-unloading device 73*x* is disposed. When the sand casting mold 2, which has undergone molten-metal pouring, is conveyed to the weight-unloading position 73 of the casting-mold conveyor line 7, the weight, which is loaded on the sand casing mold 2, is unloaded by means of the weight-unloading device 73*x*. The weight, which has been unloaded from the sand casting mold 2, is moved by means of a weight-returning device 76 in the arrowed "Y2" direction, and is then returned to the weight-loading device 71*x*. Note that the weight-returning device 76 is disposed along and parallel to the casting-mold conveyor line 7.

Figure 4:
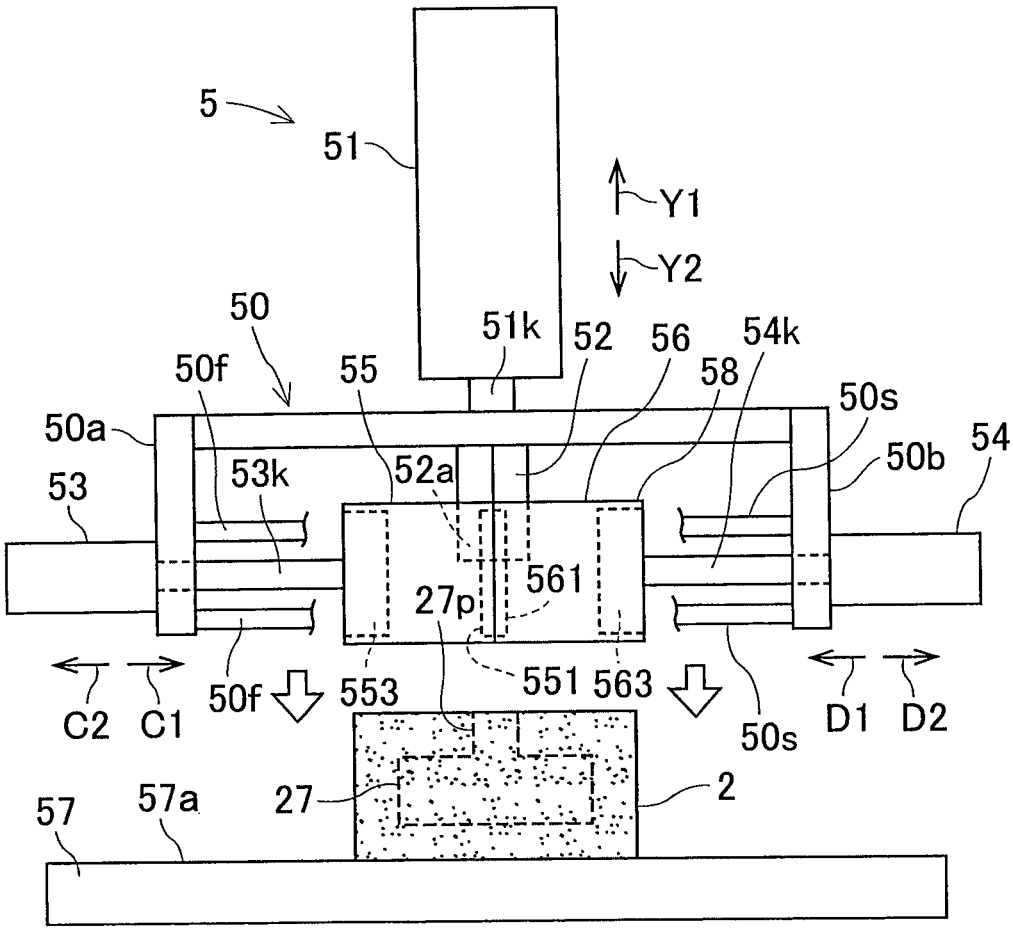
FIG. 4 is directed to Embodiment No. 1, and is a front view for illustrating a state in the middle of mold disassembling a sand casting mold that has a cast product therein schematically.
Figure 5:
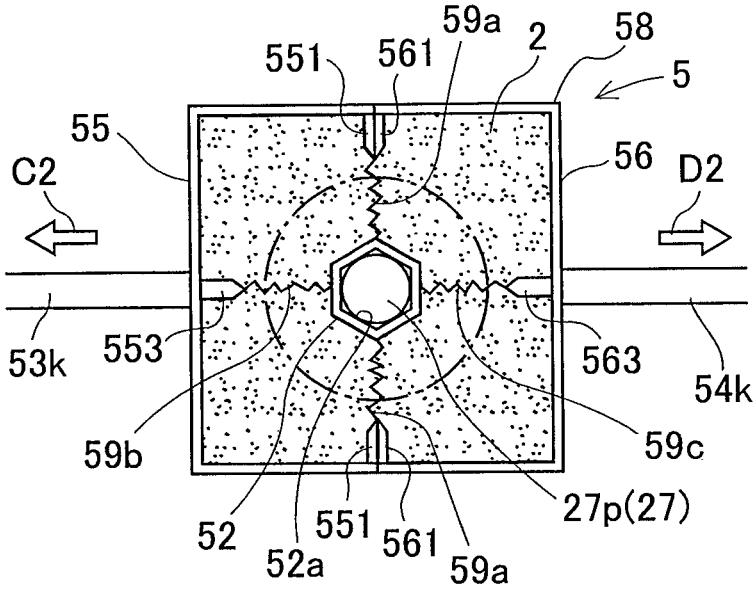
FIG. 5 is directed to Embodiment No. 1, and is a plan view for illustrating a state in the middle of mold disassembling the sand casting mold, which has a cast product therein, by means of a mold disassembler.
Figure 6:
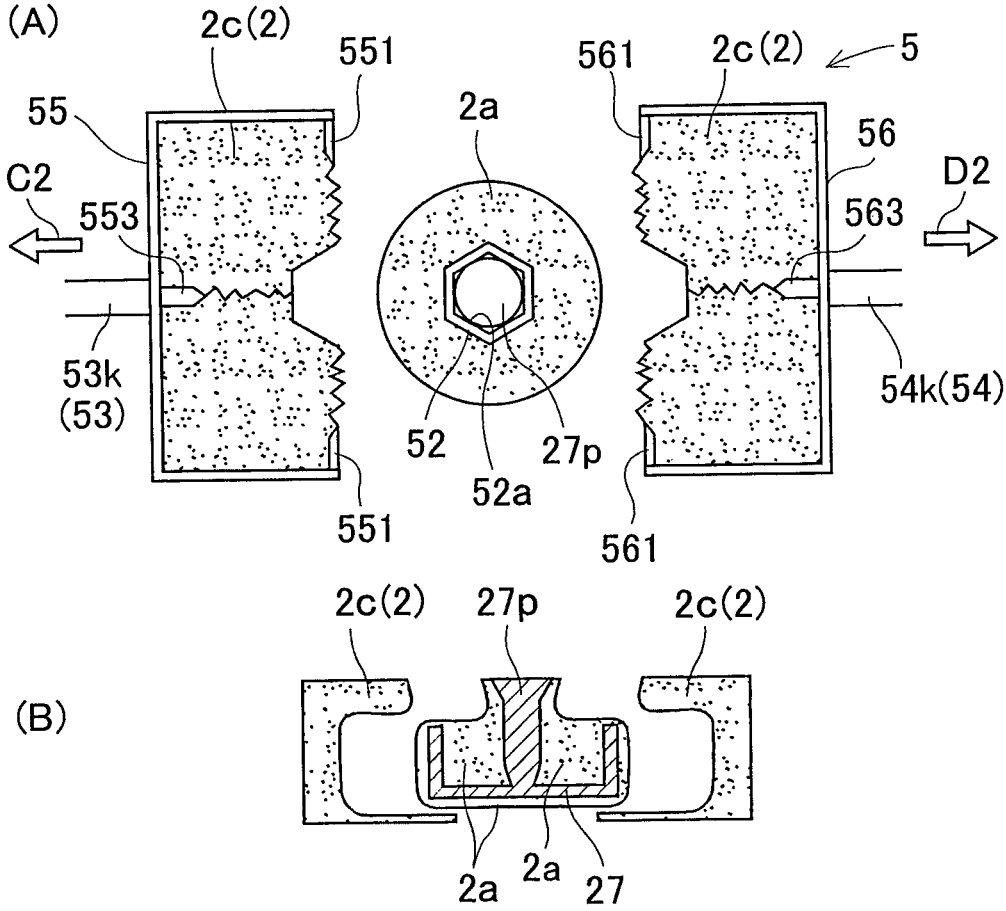
FIGS. 6 (A) and (B) are directed to Embodiment No. 1, wherein FIG. 6 (A) is a plan view for illustrating a state of mold disassembling the sand casting mold, which has a cast product therein, by means of the mold disassembler schematically.

FIG. 4 through FIG. 6 illustrate the mold disassembler 5. As shown in FIG. 4, the mold disassembler 5 is provided with the following: a movable frame 50, which has a first guide unit 50*f* and a second guide unit 50*s* (a portion of which is not shown in FIG. 4) that are disposed extendedly in a transverse direction; a main driving cylinder 51 (frame-driving source), which moves the movable frame 50 up and down in the arrowed "Y1" and "Y2" directions; a cast-product restrainer jig 52, which functions as a cast-product supporter element that is disposed on the movable frame 50; a first driving cylinder 53 (first tear-off driving source), which is retained to a first frame unit 50*a* of the movable frame 50; a second driving cylinder 54 (second tear-off driving source), which is retained to a second frame unit 50*b* of the movable frame 50; a first tearer 55 (first separator), which is moved by means of the first driving cylinder 53 in the arrowed "C1" and "C2" directions (in transverse directions) along the first guide unit 50*f*; a second tearer 56 (second separator), which is moved by means of the second driving cylinder 54 in the arrowed "D1" and "D2" directions (in transverse directions) along the second guide unit 50*s*; and a workbench 57, which possesses a working surface 57*a* onto which the sand casting mold 2 is placed.

As illustrated in FIG. 5, the cast-product restrainer jig 52 is formed as a polygonally-configured cylinder (even being a circular cylinder is allowable) that is disposed extendedly along a height direction, and has a restrainer opening 52*a* at the bottom end. The restrainer opening 52*a* restrains the sprue port 27*a* and eventually the cast product 27 by fitting into the spure port 27*a* of the cast product 27 that is buried in the sand casting mold 2, and thereby supports them. As shown in FIG. 5, the first tearer 55 is formed as a letter "U"-shaped frame configuration in plane view, and possesses a plurality of first cutters 551, which face to each other, and first intermediate cutters 553, which are disposed between the multiple first cutters 551. The second tearer 56 is formed as the same configuration as the first tearer 55 basically, though it is made reversely to it in the right and left. As illustrated in FIG. 5, the second tearer 56 is formed as a letter "U"-shaped frame configuration in plan view, and possesses a plurality of second cutters 561, which face to each other, and second intermediate cutters 563, which are disposed between the multiple second cutters 561. Note that the first cutters 551, the second cutters 561, the first intermediate cutters 553, and the second intermediate cutters 563, have a wedge function, and are capable of biting into the sand casting mold 2; accordingly they are those which can generate cracks inside the sand casting mold 2 by means of biting into it, and can thereby function as a crack generator.

Here, in FIG. 4, when the first driving cylinder 53 is driven to extend so that the first cylinder rod 53*k* of the first driving cylinder 53 advances in the arrowed "C1" direction, the first tearer 55 is activated in the arrowed "C1" direction (closing direction) along the first guide unit 50*f*. Moreover, when the second driving cylinder 54 is driven to extend so that the second cylinder rod 54*k* of the second driving cylinder 54 advances in the arrowed "D1" direction, the second tearer 56 is activated in the arrowed "D1" direction (closing direction) along the second guide unit 50*s*. As a result, as illustrated in FIG. 5, the first tearer 55, and the second tearer 56 lock integrally, and thereby form a quadrangle-shaped frame body 58 for separation. In this case, the first cutters 551 of the first tearer 55, and the second cutters 561 of the second tearer 56 join together, and thereby they form cutters similarly to those of the first intermediate cutters 553 and second intermediate cutters 563 (see FIG. 5).

FIG. 4 illustrates such a state that the first tearer 55, and the second tearer 56 lock integrally, thereby forming the frame body 58 with a predetermined configuration (quadrangular configuration) for separation; and additionally the frame body 58 for separation is put in position above the sand casting mold 2.

By the way, when disassembling the sand casting mold 2, the main driving cylinder 51 is driven so that the main cylinder rod 51*k* of the main driving cylinder 51 moves in the arrowed "Y2" direction (downward) in the state illustrated in FIG. 4, and then the frame body 58 for separation moves in the arrowed "Y2" direction (downward). As a result, the restrainer opening 52*a* of the cast-product restrainer jig 52 fits into the sprue port 27*a* of the cast product 27 that is buried in the sand casting mold 2, as shown in FIG. 5. By means of this cast-product restrainer jig 52, the spure port 27*a*, and eventually the cast product 27 are restrained at their positions, and then turn into a state of being supported. Moreover, the outer peripheral portion of the sand casting mold 2 fits in the frame body 58 for separation.

And, as the frame body 58 for separation moves in the arrowed "Y2" direction (downward), the first cutters 551 and second cutter 561 of the frame body 58 for separation bite into the inside of the sand casting mold 2 as illustrated in FIG. 5, thereby generating cracks 59*a* in the sand casting mold 2. In this case, the first intermediate cutters 553 also bite into the inside of the sand casting mold 2, thereby generating cracks 59*b* in the sand casting mold 2; and additionally the second intermediate cutters 563 also bite into the inside of the sand casting mold 2, thereby generating cracks 59*c* in the sand casting mold 2. After thus forming a plurality of the cracks 59*a*, 59*b* and 59*c* as a predetermined configuration (a cross shape, for instance) in the sand casting mold 2, the first driving cylinder 53 is driven to contract so that the first cylinder rod 53*k* of the first driving cylinder 53 retreats in the arrowed "C2" direction (in the retract direction), and then the first tearer 55 is activated in the arrowed "C2" direction (in the tearing-off direction), as illustrated in FIG. 6 (A). Moreover, the second driving cylinder 54 is driven to contract so that the second cylinder rod 54*k* of the second driving cylinder 54 retreats in the arrowed "D2" direction (in the retract direction), and then the second tearer 56 is activated in the arrowed "D2" direction (in the tearing-off direction). As a result, as shown in FIGS. 6 (A) and (B), while letting a section 2*a*, which neighbors and is in proximity to the cast product 27 and accordingly to which thermal influence is great relatively, remains around the cast product 27, a plurality of sections 2*c*, which do not neighbor and are not in proximity to the cast product 27 and accordingly to which thermal influence is less relatively, are torn off from the aforesaid section 2*a*. As a result, the sand casting mold 2 is separated into the section 2*a*, which is present around the cast product 27 and accordingly to which thermal influence is great relatively, and the sections 2*c*, which are off from the cast product 27 and are present more outside than the section 2*a* is and accordingly to which thermal influence is less relatively. Note that, in FIG. 4 through FIG. 6, the cast product 27, and the like, in FIG. 2 and FIG. 3 are drawn in more detail.

To put it differently, the outer parts of the sand casting mold 2, which has undergone molten-metal pouring and which buries the cast product 27 therein, are torn off quickly in the opposite directions to each other, and are then separated one another. Accordingly, it is possible to carry out the disassembly of the sand casting mold 2 in a short period of time. In addition, since the sand casting mold 2 is a frameless type, no time is required to detach any frame from the sand casting mold 2, and thereby the time needed for separation is shortened. Further, since the spure port 27*p*, which is restrained by means of the cast-product restrainer jig 52, is formed in the central area of the cast product 27, it is possible to tear off the sand casting mold 2 in a well-balanced manner and with ease in the opposite directions to each other by means of the first tearer 55 and second tearer 56. As aforementioned, the sand casting mold 2 possessing thermal insulatability is disassembled promptly. Therefore, the temperature of the sand casting mold 2 after disassembly (the state shown in FIGS. 6 (A) and (B)) is maintained at high temperature as much as possible. Accordingly, it is possible to accelerate the cooling rate of the after-disassembly cast product 27, and thereby controlled cooling for the metallic structure becomes feasible. Hence, it is possible to enhance the area proportion of perlite and/or bainite in the texture of the metallic structure of the cast product 27. Consequently, it is possible to enhance the mechanical strength of the cast product 27 (hardness, tensile strength, and the like). Further, since the casting sand is separated from the high-temperature cast product 27 as promptly as possible, the thermal degradation of the casting sand itself is suppressed, and thereby such an advantage is obtainable that it is able to intend making the life of casting sand longer Inside the sand casting mold 2 that has undergone molten-metal pouring and buries the cast product 27 therein, a moisture-condensed layer might be produced. It is believed that, when molten metal is poured into the sand casting mold 2, moisture evaporates, moisture which is contained in the sides of the sand casting mold 2 that are near to the molten metal; and then the evaporated moisture condenses so that a moisture-condensed layer is formed inside the sand casting mold 2. In the case where a moisture-condensed layer is formed, the moisture-condensed layer becomes a boundary, and accordingly an outside part of the sand casting mold 2 is more likely to tear off.

Note that, in accordance with the present embodiment, it is allowable that the temperature of the cast product 27 when the aforementioned mold disassembler 5 starts the disassembly operation can lie in a temperature region that exceeds A1 transformation temperature; can lie at immediately above A1 transformation temperature; or can lie in a temperature region that is less than A1 transformation temperature. Moreover, it is allowable that the temperature of the cast product 27 when the aforementioned mold disassembler 5 finishes the disassembly operation can lie in a temperature region that exceeds A1 transformation temperature; can lie at immediately above A1 transformation temperature; or can lie in a temperature region that is less than A1 transformation temperature. However, in the case where the temperature of the after-disassembly cast product is less than A1 transformation temperature, since controlled cooling becomes difficult when it is low temperature too much, it can preferably be 450° C. or more, 500° C. or more, 550° C. or more, 600° C. or more, or 650° C. or more, though it depends on composition, requested properties, and the like. The "point of time at which the disassembly operation finishes" refers to a point of time at which it is in such a state being illustrated in FIGS. 6 (A) and (B). As for a section that makes the basis for the temperature of the cast product 27, it can preferably be sections that make a basis for determining whether or not controlled cooling influences the mechanical properties of cast product greatly thereat; and accordingly the following sections are exemplified: when a thickness of cast product is expressed as 100 relatively, sections that are present deeper than the surface of cast product within a range of 3-30, or a range of 5-10, by relative representation.

In accordance with the present embodiment, the sand at the sections 2*c* to which thermal influence is less relatively, namely, undegraded sand, is collected by means of an undegraded-sand collecting device 80 (a second collecting device), and is then supplied to an undegraded-sand keeper 81 (a second keeper), as can be understood from FIG. 1. A degraded-sand separating device 82 drops off the sand at the section 2*a* to which thermal influence is great relatively, namely, degraded sand, from the cast product 27 to separate it. The degraded sand, which has been separated from the cast product 27, is collected by means of a degraded-sand collecting device 88 (a first collecting device), and is then supplied to a degraded-sand keeper 89 (a first keeper).

As illustrated in FIG. 1, a first shots-projecting device 85 is disposed in the lower reaches to the degraded-sand separating device 82. The first shots-projecting device 85 carries out a blasting treatment in which shots are projected onto the cast product 27 that has gone through the degraded-sand separating device 82, thereby dropping off degraded sand, which adheres to the cast product 27 and still remains thereon, from the cast product 27. Thus, the degraded sand, which has been dropped off from the cast product 27 by means of the blasting treatment, is collected into the degraded-sand collecting device 88, and is then supplied to the degraded-sand keeper 89. As for the shots, even iron-based ones, or even sand-based ones, are allowable; and either spherical shapes, quasi-spherical shapes, or irregular shapes are allowable. In shots projection, it is possible to start the sand drop-off operation by means of shots projection when the temperature of cast product is A1 transformation temperature or more, depending on types of the cast product 27. In this case, since the casting sand is removed from the cast product 27 almost completely by means of shots projection, it is possible to accelerate the cooling of the subsequent cast product 27 much more, and thereby it is possible to furthermore contribute to the facilitation of controlled cooling. Even if the sand drop-off operation by means of shots projection is finished when the temperature of cast product is A1 transformation temperature or more, it is possible to contribute to the facilitation of controlled cooling similarly.

Of course, it is allowable to start and/or finish the sand drop-off operation by means of shots projection when the temperature of the cast product 27 is less than A1 transformation temperature, depending on types of the cast product 27.

A first conveyor 91, which possesses a first conveyor belt for conveying sand, and the like, is disposed between the aforementioned degraded-sand keeper 89 and a second kneader 96. The first conveyor 91 conveys the degraded sand, which has been collected by means of the degraded-sand collecting device 88, to the second kneader 96 from the degraded-sand keeper 89 by way of a first kneader 95 and an aging tank 97. A second conveyor 92, which possesses a second conveyor belt for conveying the undegraded sand to the second kneader 96, and so forth, is disposed between the undegraded-sand keeper 81 and the second kneader 96.

To put it differently, in accordance with the present embodiment, the kneader 94 for kneading casting sand is formed of the aforementioned first kneader 95 and second kneader 96. In order to intend the recovery treatment for the degraded sand that has been separated by the separator 50, the first kneader 95 improves the properties of the degraded casting sand by means of blending an additive material for sand, and water with the degraded sand, thereby forming the casting sand. The second kneader 96 blends the casting sand, which has been kneaded by the first kneader 95 (one which has been made by performing the recovery treatment to the degraded sand), and the undegraded sand, which has been separated by the separator 50, with water, and then kneads them. Thus, the second kneader 96 forms the casting sand for making mold, casting sand which is made into a mold by the mold maker 3. In this case, for the second kneader 96, a system is employed, system which does not blend an additive agent with entire casting sand, which forms the casting sand for making mold, but which puts an emphasis on the degraded sand to which thermal influence is great relatively, and which thereby blends an additive material for sand with the degraded sand emphatically to knead therewith. Accordingly, it is possible to make the consumption amount of additive agent for sand as less as possible while securing the stability of the qualities of the casting sand for making mold, and thereby it is possible to contribute to cost reduction. The casting sand for making mold, which has been kneaded by the second kneader 96, is conveyed from the second kneader 96 toward the mold maker 3 by means of a third conveyor 93 that possesses a third conveyor belt, and the like.

The cutter 6 has machine tool, such as lathe, for cut processing the cast product 27, which has been disassembled from the sand casting mold 2, by means of a cutting tool 6*a*. The cast product 27, which has been cut by means of the cutting tool 6*a* at the cutter 6, is accommodated in a completed-product accommodating case 60 by way of a conveyor chute 60*a*.

In accordance with the present embodiment, a cast-product keeper 67 is disposed to the upper reaches of the cutter 6. The cast-product keeps 67 keeps the cast product 27, which has been taken out from out of the sand casting mold 2 and which is before cutting, therein temporarily. To the cast-product keep 67, a cast-product cooling device 68 is annexed, cast-product cooling device 68 which is for adjusting the cooling rate of the before-cutting cast product 27 that is kept by the cast-product keeper 67. The cast-product cooling device 68 is adapted into an air-cooling device for blowing air for cooling (ordinary cooling medium) to the before-cutting cast product 27. The cooling rate of the cast product 27 is accelerated furthermore by means of blowing air, and thereby it is possible to enhance the area proportion of perlite in the cast product 27. Further, the cast-product cooling device 68 possesses a quencher 68*c* for bringing mist (cooling facilitator medium), which includes water vapor for cooling, or liquid coolant water (high-speed cooling medium), into contact with the cast product 27. When it is preferable to furthermore accelerate the cooling rate, the mist or liquid coolant water is spewed out from the quencher 68*c* to the cast product 27.

In accordance with the present embodiment, as can be understood from FIG. 1, the respective steps, like the mold-making step for the sand casting mold 2, the molten-metal pouring step, the mold-disassembling step for the sand casting mold 2, and the cut-processing step with respect to the after-disassembly cast product 27, are adapted, not into the closed circular loop-shaped layout disposition, but into a linear layout disposition, and accordingly the increment of installation area is suppressed. Suppose if it is a closed loop-shaped disposition, since the diameter of closed loop increases when the size of the sand casting mold 2 enlarges, there is such a fear that the entire installation area might increase.

As having been explained above, in accordance with the present embodiment, it is adapted so that the sand casting mold 2 is disassembled in such a state that a portion of the cast product 27 is supported by means of the cast-product restrainer jig 52 that serves as a cast-product supporter element. Accordingly, without ever using the jumbolized casting-mold disassembling apparatuses that are directed to the related art (Patent Literature Nos. 2 and 3), it is possible to separate the cast product 27 from the casting sand favorably. To put it differently, since it is adapted so that the sand casting mold 2 is disassembled at the mold disassembler 5 in such a state that the cast product 27 is supported by means of the cast-product restrainer jig 52, the movement of the cast product 27 is withheld during the mold disassembly, in contrast to the rotary drum type. Further, it is even allowable not to employ the box-shaped decompressing container, and the vacuum source being connected with the decompressing container. Consequently, it is possible to intend the downsizing of the mold disassembler 5, and eventually the downsizing of the apparatus for cast-product production line.

Further, in such a state that a portion of the cast product 27 is supported by means of the cast-product restrainer jig 52 that serves as a cast-product supporter element, it is adapted so that the sand casting mold 2 is disassembled. Therefore, it is possible to maintain the temperature of the after-disassembly cast product 27 in high-temperature state as much as possible. Hence, controlled cooling for accelerating the cooling rate of the after-disassembly cast product 27 becomes feasible, and thereby it is possible to contribute to strengthening the texture of the metallic structure of the cast product 27. Concretely speaking, it is possible to increase the proportion of perlite or bainite. Since the shot-projecting treatment that is performed thereafter can also be carried out when the cast product 27 is in high-temperature state as much as possible, it is possible to contribute to the controlled cooling furthermore.

In accordance with the present embodiment, since the high-temperature cast product 27 is separated from the casting sand as early as possible as described above, the time for leaving the cast product 27 being buried in the sand casting mold 2 is shortened. Hence, it is possible to shorten the distance from the molten-metal pourer 4 to the mold disassembler 5, and thereby it is possible to intend making the installation area of the entire apparatus more compact. Since the high-temperature cast product 27 is separated from the casting sand as early as possible, the time during which the cast product 27 contacts the casting sand is shortened. Hence, the thermal degradation of the casting sand is suppressed, and thereby making the longevity of the casting sand longer can be intended.

In accordance with the present embodiment, the sprue port 27*b* that is a section other than one of the product proper parts of the cast product 27 is restrained onto the working surface 57*a* of the workbench 57 by means of the cast-product restrainer jig 52, thereby retaining it thereon. Accordingly, damages to the product proper parts of the cast product 27 are reduced or avoided. Especially, since the cast product 27 is restrained by means of the cast-product restrainer jig 52 on the occasion when disassembling the sand casting mold 2 on the working surface 57*a* of the workbench 57, the cast product 27 on the workbench 57 neither moves excessively nor rolls excessively. Hence, it is possible to contribute to the downsizing of the workbench 57, and eventually to the downsizing of the mold disassembler 5.

Further, in accordance with the present embodiment, it has the following jointly: the melter 1 for forming molten metal by melting a meltable material; the kneader 94 for kneading casting sand for making mold; the mold maker 3 for making the sand casting mold 2 of the casting sand for making mold, sand casting mold 2 which is provided with the molding cavity 23 for forming the singular (one-piece) cast product 27; the molten-metal pourer 4 for pouring the molten metal into the molding cavity 23 of the sand casting mold 2; the mold disassembler 5 for disassembling the sand casting mold 2 that has undergone molten-metal pouring; and the cutter 6 for cut processing the cast product 27 that has been disassembled from the sand casting mold 2. Accordingly, it is possible to carry out the following continuously: from the melting of meltable material, the mold making of the sand casting mold 2, the molten-metal pouring, the mold disassembly of the after-molten-metal-pouring sand casting mold 2, and up to the cut processing with respect to the after-disassembly cast product 27. That is, it is possible to manufacture the cast product 27 one by one by a series of a sole production line. Therefore, it is possible to reduce loss, such as intermediate stocks, and thereby it is possible to reduce production cost.

As aforementioned, in accordance with the present embodiment, since the casting step and the cutting step are integrated, it is possible to quickly cut process the cast product 27 that is immediately after having gone through the casting step and whose temperature has been still higher than ordinary temperature. Therefore, it is possible to feed back information regarding the cast product 27 that is acquired by cut processing (chill generation circumstances or sand adhesion circumstances in the cast product 27) to the melter 1 or the mold maker 3 immediately. Accordingly, it is possible to suppress the occurrence of chill in the cast product 27; or it is possible to suppress the decline of the dimensional accuracy of the cast product 27; and thereby it is possible to intend the improvement of the qualities of the cast product 27.

In accordance with the present embodiment, all the sand casting molds 2 that are made by the mold maker 3 are a mold for one-piece production, and accordingly they cast the cast product 27 individually. Therefore, even when the kind or type of the cast product 27 is altered, all the sand casting molds 2 are those which cast the cast product 27 individually. Hence, in the sand casting molds 2, the position of the singular cast product 27 is disposed fixedly. Accordingly, even when producing the cast product 27 in a large number of pieces, it is possible to reduce fluctuations in the solidifying rate of the cast products 27, the cooling rate after solidification, and the like, and thereby it is possible to contribute to the uniformization of the qualities of the cast products 27.

Moreover, as described above, the apparatus for cast-product production line that is directed to the present embodiment employs a system which manufactures the singular (one-piece) cast product 27 alone in one set of the sand casting molds 2. Accordingly, the molten-metal pouring conditions with respect to the cast products 27, the mold-making conditions for the sand casting molds 2 for molding that cast products 27, and the like, become inherent ones to those cast products 27. That is, it is possible to construct a production system that the manufacture histories on the occasion when manufacturing the cast products 27 can correspond with one another one-on-one in the respective cast products 27. Consequently, it becomes possible to record the molten-metal pouring conditions with respect to the cast products 27, the mold-making conditions for the sand casting molds 2 for molding that cast products 27, and so forth, on the control device's recording medium, such as memory, for every cast product 27. In this case, even when manufacturing the cast product 27 in a quantity of large numbers and in multiple kinds, traceability becomes feasible, traceability that makes it possible to pursue the manufacture history of each of the cast products 27 one by one. By means of this, even if drawback should have occurred in one of the cast products 27, feedback for quickly dealing with it becomes feasible, feedback which pursues the factors of that drawback to correct them, and thereby it is possible to further contribute to making the cast products 27 be of high quality.

As aforementioned, in accordance with the present embodiment, a system is employed, system in which cut processing is performed at once with respect to the cast product 27 that has been taken out from out of the sand casting mold 2 by means of the mold disassembler 5. Accordingly, it is needed to promptly cool the cast product 27 that has been taken out from out of the sand casting mold 2. And so, it is adapted so that the before-cutting cast product 27, which is kept by the cast-product keeper 67, is cooled forcibly by means of the cast-product cooling device 68. Thus, it is possible to contribute to controlled cooling; and additionally it is possible to perform cut processing at once with respect to the cast product 27 that has been taken out from out of the sand casting mold 2; and thereby it is possible to enhance the productivity. Therefore, the operation is abolished, operation in which the before-cutting cast product 27 being kept by the cast-product keeper 67 is left as it is over long period of time; and it is possible to save the space for the cast-product keeper 67; and additionally it is possible to contribute to the improvement of productivity.

Moreover, as described above, in accordance with the present embodiment, with regard to the casting sand after casting, the degraded sand to which thermal influence resulting from molten metal is great relatively is sorted out from the undegraded sand to which thermal influence resulting from molten metal is small relatively, and is then collected. And, a system is employed, system in which an additive agent is not blended with the entirety of casting sand after casting, but in which an emphasis is put on the degraded sand to which thermal influence resulting from molten metal is great relatively and an additive material for sand is blended with this emphatically. And, regarding the undegraded sand to which thermal influence resulting from molten metal is small relatively, it is adapted so that the additive material for sand is not at all blended therewith, or so that, compared with that to the degraded sand, it is blended therewith in a small amount. Specifically, when a blending amount of the additive material for sand to be blended with the degraded casting sand to which thermal influence is great relatively (per unit mass of the degraded casting sand) is taken as "Wa" and a blending amount of the additive material for sand to be blended with the undegraded casting sand to which thermal influence is small relatively (per unit mass of the undegraded casting sand) is taken as "Wb," "Wa" is set greater than "Wb." Accordingly, while securing the stability of the casting sand for making mold, it is possible to make the consumption amount of the additive agent for sand as less as possible, and thereby an advantage that contributes to cost reduction is obtained.

To put it differently, in accordance with the present embodiment, it is adapted so that casting sand whose properties have been improved by adding the additive material for sand emphatically with respect to the degraded sand to which thermal influence is great relatively at the first kneader 95, and the undegraded sand to which thermal influence is less relatively are blended in a certain blending proportion at the second kneader 96. Accordingly, it is possible to make fluctuations of the qualities of the casting sand for making mold that forms the sand casting mold 2 smaller.

Further, in accordance with the present embodiment, the cast product 27, which has been kept by the cast-product keeper 67, arrives at an as-cast assembly separating device 69 by means of a conveying device 100. And, before cut processing, an as-cast portion 27*m* is separated from that cast product 27 by means of the as-cast assembly separating device 69. The "as-cast portion 27*m*" means sections of solidified metal that the molten metal has made by solidifying, sections which turn into other than a product, the cast product 27, (spure port, sprue runner, gate, gas-venting portion, and the like). After the as-cast portion 27*m* has been separated, the cast product 27 is conveyed to the cutter 6 by means of a conveying device 101. In the middle of being conveyed to the cutter 6 by means of the conveying device 101, shots are projected onto the before-cutting cast product 27 by means of a secondary shotting device 103. The as-cast portion 27*m*, which has been separated from the cast product 27, is still warm (40-100° C. approximately, for instance). This as-cast portion 27*m* is conveyed at once to the melter 1 after being separated from the cast product 27, and is then used as the meltable material. Accordingly, it is possible to promptly melt the as-cast portion 27*m* as the meltable material by the melter 1 without ever elapsing time during which rust and so forth occur in the as-cast portion 27*m*. Consequently, not only it is possible to contribute to reducing energy cost at the melter 1 but also it is possible to contribute to the stabilization of the qualities of molten metal, and eventually it is possible to contribute to the stability of the qualities of the cast product 27.

Embodiment No. 2

Figure 7:
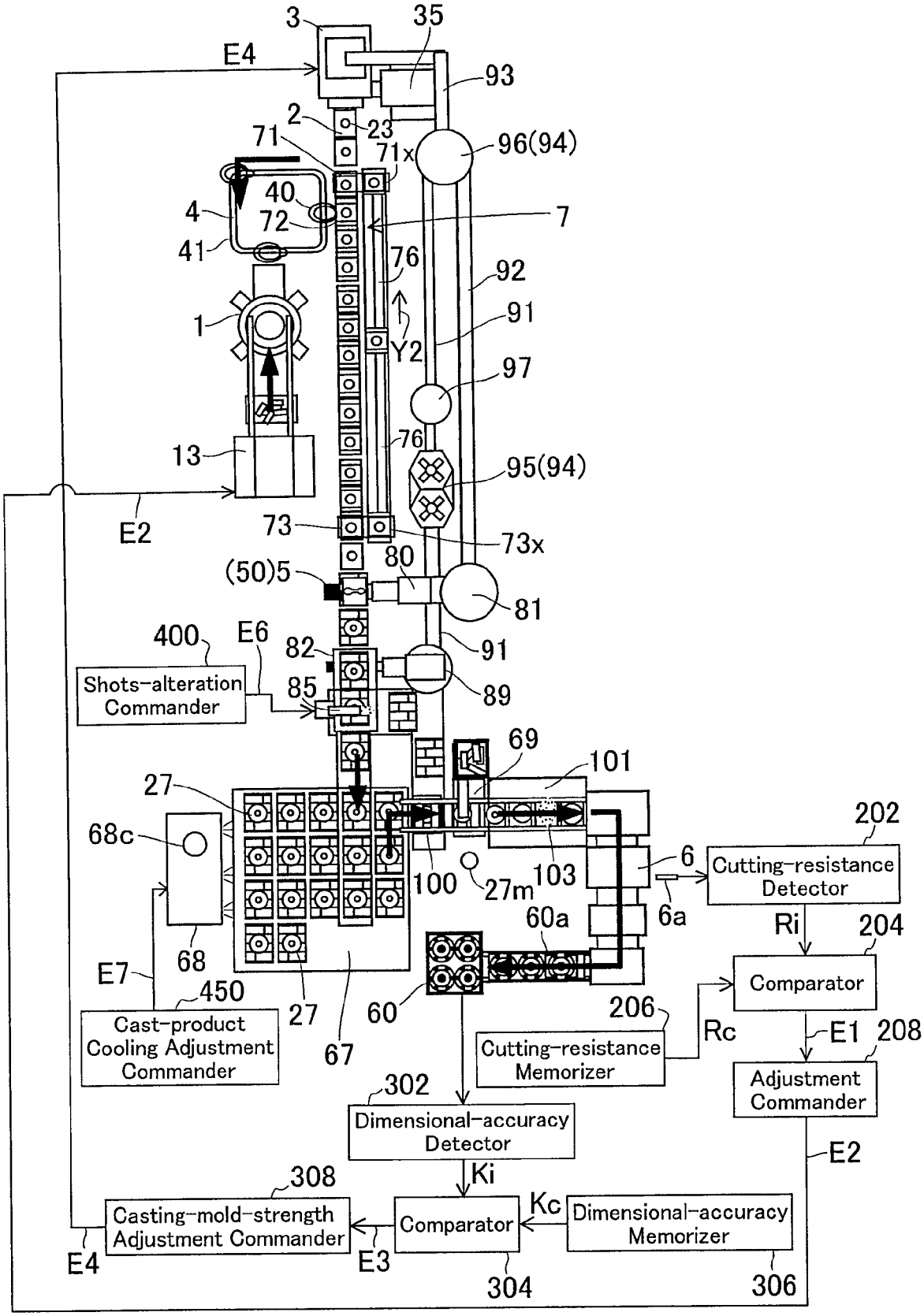
FIG. 7 is a plan view for illustrating an apparatus for cast-product production line schematically.

FIG. 7 illustrates Embodiment No. 2. The present embodiment has the same construction and operations/effects as those of Embodiment No. 1 basically. Common sections are designated with common symbols. Hereinafter, it will be explained while centering on distinct parts. In accordance with the present embodiment, a cutting-resistance detector 202 (torque sensor, for instance) is disposed in the cutting tool 6*a* that is employed in the cutter 6, cutting-resistance detector 202 which is for detecting cutting resistance at a time of cutting the cast product 27 by the cutting tool 6*a*. A comparator 204 compares cutting resistance "Ri" of the cast product 27, which is detected by the cutting-resistance detector 202, with datum cutting resistance "Rc," which is memorized in a cutting-resistance memorizer 206 that is formed of memory or the like. When the comparator 204 judges that the difference between the cutting resistance "Ri" and the datum cutting resistance "Rc" is so great that abnormality is acknowledged in cutting resistance at a time of cutting the cast product 27, it outputs a cutting-resistance abnormality signal "E1" to an adjustment commander 208. Here, when the cutting resistance is abnormal in excessive direction, it is presumed that the cutting tool 6*a* is cutting chill. Because of this fact, it halts the cutting at the cutter 6 immediately.

As aforementioned, when abnormality is acknowledged in the cutting resistance of the cast product 27, the adjustment commander 208 judges that chill occurs in the surface of the cast product 27 based on the cutting-resistance abnormality signal "E1" from the comparator 204, and then outputs a command signal "E2" to the material charger 13, command signal "E2" which is for adjustment so as to increase an amount of additive material for molten metal that is to be added to the meltable material. Thus, the additive agent for molten metal, additive agent which is to be added to the meltable material from the material charger 13, is increased in amount, and thereby chill in the cast product 27 comes to be suppressed. Here, as for the additive material for molten metal, carbon-based material and/or silicon-based material are named. Since the carbon equivalent weight of molten metal increases when carbon-based material and/or silicon-based material are increased in amount, chill in the cast product 27 is suppressed.

Further, in accordance with the present embodiment, a dimensional-accuracy detector 302 is annexed to the completed-product accommodating case 60, dimensional-accuracy detector 302 which is for detecting dimensional accuracy of the after-cutting cast product 27. A comparator 304 compares dimensional accuracy "Ki," which is detected by the dimensional-accuracy detector 302, with datum dimensional accuracy "Kc," which is memorized in a dimensional-accuracy memorizer 306 that is formed of memory or the like. When the comparator 304 judges that both of them differ considerably so that abnormality is acknowledged in the dimensional accuracy "Ki," it outputs a dimensional-accuracy abnormality signal "E3" to a casting-mold-strength adjustment commander 308. And, based on the dimensional-accuracy abnormality signal "E3," the casting-mold-strength adjustment commander 308 outputs a command signal "E4" to the mold maker 3, command signal "E4" which is for adjusting casting-mold strength at the mold maker 3. To be more precise, when a thickness-wise dimension of the cast product 27 is slightly bigger than a datum dimension, it outputs the command signal "E4," which is for increasing the casting-mold strength of the sand casting mold 2, to the mold maker 3, because it is presumed that the casting-mold thickness of the sand casting mold 2 is insufficient with respect to the pressure of molten metal that has been poured into the sand casting mold 2.

Further, the first shots-projecting device 85 is provided with a shots-alteration commander 400. When alteration magnitude of the before-shots-projection cast product 27 is great, that is, when the type and/or material quality of the cast product 27 has been altered greatly, the shots-alteration commander 400 outputs a command signal "E6" to the first shot-projection device 85, command signal "E6" which is for altering the projection time and/or projection amount of shots to be projected, depending on properties of cast product. Thus, shots, which comply with the type and/or material quality of the cast product 27, are projected onto the cast product 27. Thus, even when the type and/or material quality of the cast product 27 has been altered, the shots-blasting treatment with respect to the before-cutting cast product 27 is made favorable, because shots are projected depending on the properties of the before-cutting cast product 27.

By the way, when a system for manufacturing a plurality of the cast products 27 by one set of the sand casting molds 2, the probability that the placement positions of the cast products 27 in the sand casting molds 2 differ becomes higher. That is, the cast products 27 that are cast on the central side of the sand casting molds 2 exist, or the cast products 27 that are cast on the end sides of the sand casting molds 2 exist. In this case, there is such a fear that the cooling rate of molten metal that has been poured into the sand casting molds 2 fluctuates, or dimension of the molding cavity 23 fluctuates depending on sections of the molding cavity 23 of the sand casting molds 2. In this case, such a probability that chill-generating degree fluctuates for each one of the cast products 27 becomes higher, or such a probability that dimensional accuracy fluctuates for each one of the cast products 27 becomes higher.

With this issue, in accordance with the present embodiment, a system is employed, system in which only the singular cast product 27 is cast in the central area of one set of the sand casting molds 2. Accordingly, the fluctuation of the cooling rate of molten metal that has been poured into the sand casting molds 2, and the dimensional fluctuation in the molding cavity 23 of the sand casting molds 2 are suppressed. Consequently, the fluctuation in the cutting resistance for every cast product 27 is reduced, cutting resistance which is detected by the cutting-resistance detector 202. Hence, when the charging amount of carbon-based material and/or silicon-based material is adjusted by means of the adjustment commander 208 based on the cutting resistance that is detected by the cutting-resistance detector 202, it is possible to enhance accuracy for suppressing chill generation in the respective cast products 27, and thereby it is possible to contribute to making the cast products 27 be of high quality furthermore. Similarly, the fluctuation in the dimensional accuracy for every cast product 27 is reduced, dimensional accuracy which is detected by the dimensional-accuracy detector 302. Hence, when the casting-mold strength of the sand casting mold 2 is adjusted by means of the casting-mold-strength adjustment commander 308 based on the dimensional accuracy that is detected by the dimensional-accuracy detector 302, it is possible to enhance accuracy for suppressing the fluctuation of the dimensional accuracy in the respective cast products 27, and thereby it is possible to contribute to making the cast products 27 be of high quality furthermore.

Moreover, in accordance with the present embodiment, the space that the cast products 27 occupy enlarges when a kept number of the cast products 27 that are kept by the cast-product keeper 67 increases. Hence, when the kept number of the cast products 27 that are kept by the cast-product keeper 67 increases, or when the temperature of the cast products 27 that are kept by the cast-product keeper 67 is high for cut processing, a cast-product cooling adjustment commander 450 outputs a command signal "E7" to a cast-product cooling device 68, command signal "E7" which is for accelerating the cooling rate of the cast products 27 that are kept by the cast-product keeper 67. Thus, since the cooling rate of the cast products 27 that are kept by the cast-product keeper 67 accelerates, it is possible to withhold the increment of the kept number (intermediate-stock number) of the before-cutting cast products 27 that are kept by the cast-product keeper 67. Consequently, it is possible to intend the downsizing of the cast-product keeper 67.

Embodiment No. 3

Since the present embodiment has the same construction and operations/effects as those of Embodiment Nos. 1 and 2 basically, FIG. 1 and FIG. 7 will be applied to it correspondingly. Hereinafter, it will be explained while centering on distinct parts. In general, at a time when iron-carbon system cast iron cools, the cooling rate that passes A1 transformation temperature from high-temperature region that is higher than the A1 transformation temperature influences making the crystal grains of metallic structure finer. However, when the cast product 27 has a large size, there is limitation on the cooling rate. Hence, in accordance with the present embodiment, the temperature of the after-disassembly cast product 27 exceeds the A1 transformation temperature. Since the shots projection is done for a short period of time, the temperature of the after-shots-projection cast product 27 also follows this. When one would like to pass the temperature of the cast product 27 the A1 transformation temperature at rapid rate, the cast-product cooling adjustment commander 450 outputs a command signal "E7" to the cast-product cooling device 68, command signal "E7" which is for accelerating the cooling rate of the before-cutting cast products 27 that are kept by the cast-product keeper 67. Thus, the air-blowing amount or air-blowing power of air for cooling that comes from the cast-product cooling device 68 is enhanced. Alternatively, mist, or coolant water depending on circumstances, is supplied to the cast products 27. Hence, even in the case where the heat capacity of the cast products 27 that are kept by the cast-product keeper 67 is large, it is possible to make the cast products 27's cooling rate that passes the A1 transformation temperature faster, and thereby making the crystal grains of the cast products 27's metallic structure finer is intended. In this case, it is possible to increase the mechanical properties (hardness, tensile strength, and the like) of the cast products 27.

Embodiment No. 4

Since the present embodiment has the same construction and operations/effects as those of Embodiment Nos. 1 and 2 basically, FIG. 1 and FIG. 7 will be applied to it correspondingly. Hereinafter, it will be explained while centering on distinct parts. In accordance with the present embodiment, the temperature of the after-disassembly cast product 27 is less than A1 transformation temperature and 450° C. or more. Since the shots projection is done for a short period of time, the temperature of the after-shots-projection cast product 27 also follows this. And, the cast-product cooling adjustment commander 450 outputs a command signal "E7" to the cast-product cooling device 68, command signal "E7" which is for accelerating the cooling rate of the before-cutting cast products 27 that are kept by the cast-product keeper 67. Thus, the air-blowing amount or air-blowing power of air for cooling that comes from the cast-product cooling device 68 is enhanced. Depending on circumstances, mist or coolant water is supplied to the cast products 27, thereby facilitating the cooling. Hence, even in the case where the heat capacity of the cast products 27 that are kept by the cast-product keeper 67 is large, it is possible to make the cast products 27's cooling rate in the temperature region of less than the A1 transformation temperature faster.

Embodiment No. 5

Since the present embodiment has the same construction and operations/effects as those of Embodiment Nos. 1 and 2 basically, FIG. 1 and FIG. 7 will be applied to it correspondingly. Hereinafter, it will be explained while centering on distinct parts. In accordance with the present embodiment, the temperature of the after-disassembly cast product 27 falls in a range of plus/minus 15° C. when the A1 transformation is taken as a datum. Since the shots projection is done for a short period of time, the temperature of the after shot-projection cast product 27 also follows this. In the present embodiment as well, air for cooling, mist or coolant water that comes from the cast-product cooling device 68 is brought into contact with the cast products 27 that are kept by the cast-product keeper 67, thereby accelerating the cooling rate of the cast products 27.

Embodiment No. 6

Since the present embodiment has the same construction and operations/effects as those of Embodiment No. 2 basically, FIG. 7 will be applied to it correspondingly. In accordance with the present embodiment, a cutting-resistance detector 202 (torque sensor, for instance) is disposed in the cutting tool 6*a* that is employed in the cutter 6, cutting-resistance detector 202 which is for detecting cutting resistance at a time of cutting the cast product 27. The composition of molten metal is a composition that does not generate chill (hypereutectic composition, for instance). Therefore, when the cast product 27's cutting resistance that is detected by the cutting-resistance detector 202 is abnormal in excessive direction, the adjustment commander 208 presumes that the casting sand adheres on the cast product 27's cut part, based on the cutting-resistance abnormality signal "E1" from the comparator 204. Accordingly, in order to peel off the casting sand that adheres on the cast product 27's cut part, the adjustment commander 208 outputs a command signal to the shots-alteration commander 400, command signal which is for altering shots to those with higher grinding-off power or for increasing the projection time of shots or the projection power of shots. Thus, the conditions (projection time and/or projection amount) of shots that are projected by the first shots-projecting device 85 are altered. Thus, the sand falling-off property in the cast product 27 upgrades.

Moreover, as described above, because of the fact that a system is employed, system in which only the singular cast product 27 is cast in the central area of one set of the sand casting molds 2, since the fluctuation of the casting sand's adhesion circumstances for every cast product 27 is suppressed, suppose if, in the case where the casting sand adheres onto the cast product 27's cut part, the fluctuation of sand falling-off property that results from the shots projection is suppressed, and thereby it is possible to contribute to making the cast products 27 be of high quality furthermore.

Embodiment No. 7

(Test Example No. 1) Based on one of the aforementioned embodiments, Test Example No. 1 was performed. In this case, the cast product 27 was formed of spheroidal graphite cast iron. In this case, molten metal, which had been subjected to spheroidizing treatment by means of spheroidizing agent including magnesium, was poured into the cavity of the sand casting mold 2 (molten-metal pouring temperature: 1,430° C.), and then the cast product 27 was formed (spheroidal graphite cast iron, maximum thickness: 30 millimeters, product name: differential case). Thereafter, the outside parts of the sand casting mold 2 were torn off from the cast product 27 by means of the first tearer 55 and second tearer 56 after cracks were generated in the sand casting mold 2 in which the cast product 27 was buried. The temperature of the cast product 27 immediately after the tearing off was A1 transformation temperature or more. Immediately thereafter, shots were projected onto the cast product 27, thereby carrying out sand dropping-down operation. The temperature of the cast product 27 immediately after the sand dropping-down operation was the A1 transformation temperature or more.

Figure 8:
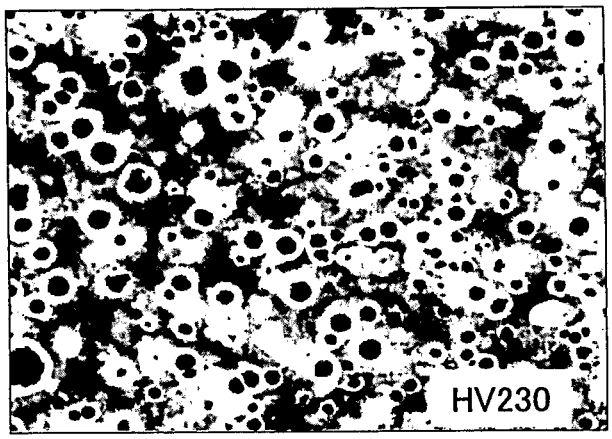
FIG. 8 is a copy of photograph (magnification: hundred-fold) for illustrating the structure of spheroidal graphite cast iron that underwent controlled cooling.

FIG. 8 illustrates the metallic structure of the cast product 27, which was directed to Test Example No. 1 that had gone through processes like these (magnification: hundredfold, "Nital" etching). As shown in FIG. 8, a structure was formed, structure which possessed bull's eyes in which ferrite (white-colored area) was generated around spheroidal graphite. The texture of the structure was adapted into being perlite (black-colored area) basically. Accordingly, the strength and hardness of the texture were high. In this case, it was made so that carbon was 3.85% by mass, silicon was 2.85% by mass, and magnesium was 0.04% by mass.

Figure 9:
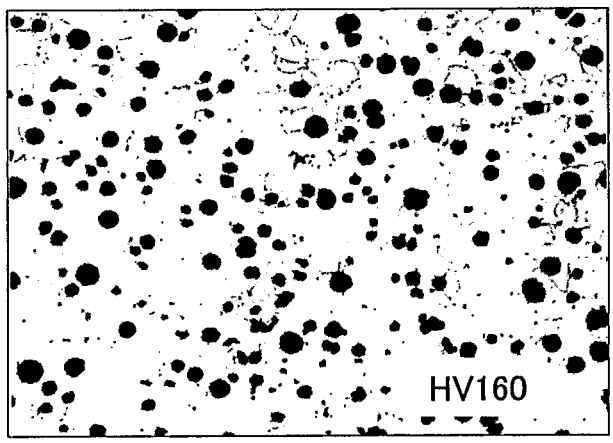
FIG. 9 is a copy of photograph (magnification: hundred-fold) for illustrating the structure of spheroidal graphite cast iron that did not undergo controlled cooling.

Further, as Comparative Example No. 1, molten metal that had been subjected to spheroidizing treatment was poured into the sand casting mold 2, the sand casting mold 2 was left as it was while keeping the cast product 27 being buried inside it, and then the cast product 27 was cooled gradually down to and around ordinary temperature. In Test Example No. 1 and Comparative Example No. 1, the casting conditions, molten-metal pouring temperature, molten-metal composition, magnesium content, and the like, were made identical one another basically. FIG. 9 illustrates the metallic structure, which was directed to Comparative Example No. 1 (magnification: hundredfold, "Nital" etching). In accordance with Comparative Example No. 1, almost all of the textures around the graphite grains were adapted into being ferrite (white-colored area), as shown in FIG. 9. Accordingly, the hardness and strength were lower than those of Test Example No. 1. Since graphite is spherical in spheroidal graphite cast iron, the notch effect of graphite is less so that, if the texture is strengthened, further strengthening of spheroidal graphite cast iron is expected. Therefore, texture strengthening by means of controlled cooling is meaningful for upgrading strength in spheroidal graphite cast iron. Furthermore, since the strengthening of texture can be intended by means of controlled cooling, it is possible to expect to reduce alloying element for texture strengthening, such as manganese, and thereby it is possible to contribute to reducing cost while enhancing the strength of cast product. Note that similar effects are expectable even when the temperature of the cast product 27 immediately after being torn off is adapted into being A1 transformation temperature or more and the temperature of the cast product 27 immediately after finishing sand dropping-down operation by means of shots is adapted into being less than the A1 transformation temperature.

(Test Example No. 2) Moreover, Test Example No. 2 was performed based on aforementioned Embodiment No. 1. In this case, the cast product 27 was formed of flaky graphite cast iron. In this case, molten metal was poured into the cavity of the sand casting mold 2 (molten-metal pouring temperature: 1,390° C.), and then the cast product 27 was formed (flaky graphite cast iron, maximum thickness: 30 millimeters, product name: brake drum). In this case, it was made so that carbon was 3.35% by mass, and silicon was 2.1% by mass. Thereafter, the outside parts of the sand casting mold 2 were torn off from the cast product 27 by means of the first tearer 55 and second tearer 56 after cracks were generated in the sand casting mold 2 in which the cast product 27 was buried. Immediately thereafter, the casting sand, which adhered on the cast product 27, was separated promptly from the cast product 27 by means of projecting shots onto the cast product 27. Further, as Comparative Example No. 2, molten metal was poured into the sand casting mold 2, the sand casting mold 2 was left as it was while keeping the cast product 27 being buried inside it, and then the cast product 27 was cooled slowly (was cooled gradually) down to and around ordinary temperature.

Figure 10:
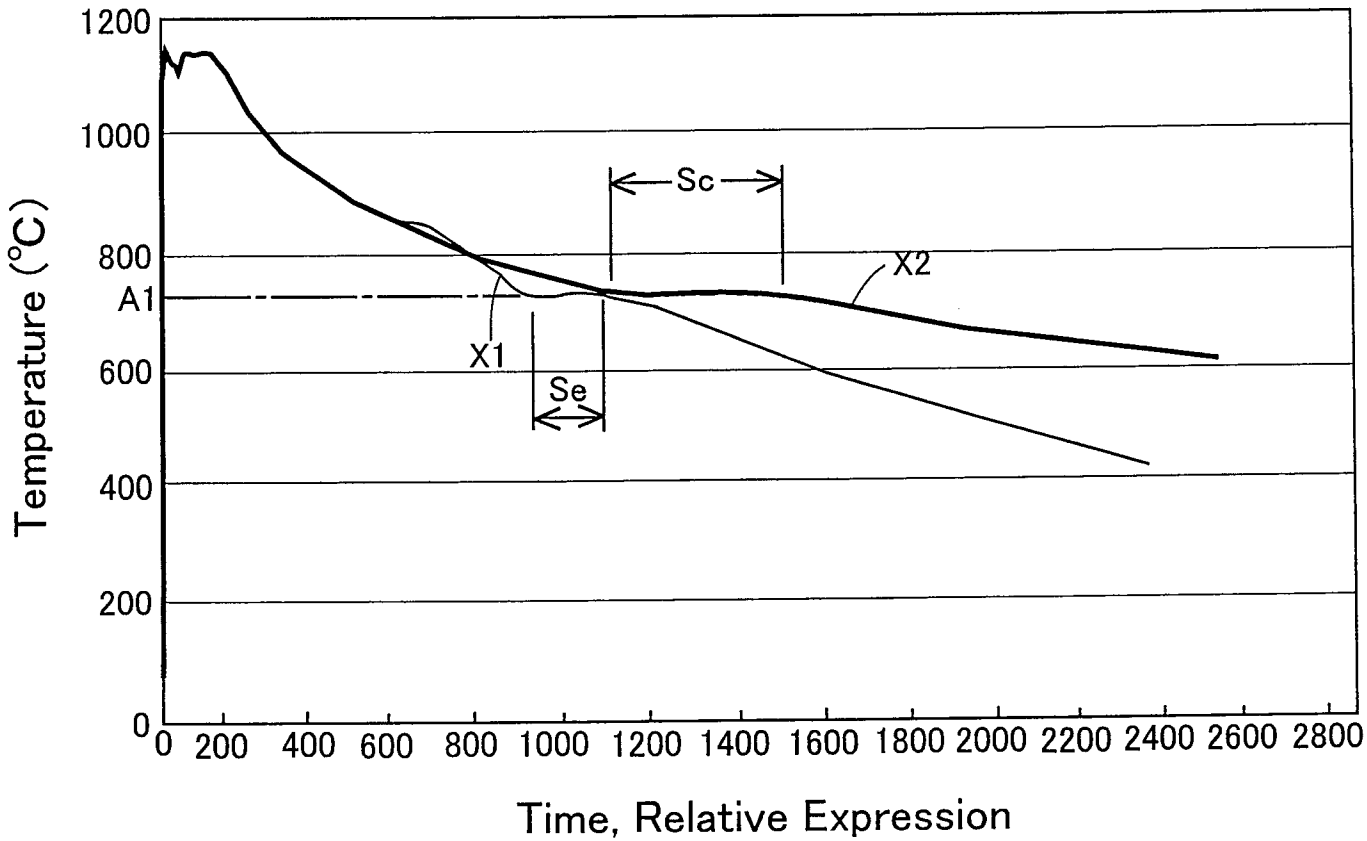
FIG. 10 is a graph for illustrating cooling curves regarding flaky graphite cast iron in the case that it underwent controlled cooling, and in the case that it did not undergo controlled cooling.

FIG. 10 illustrates the cooling curves of the cast products 27 that had gone through processes like these. The characteristic curve "X1" represents Test Example No. 2, and the characteristic curve "X2" represents Comparative Example No. 2. As shown in FIG. 10, in the characteristic curve "X1" and characteristic curve "X2," temperature stationary regions were observed at around 740° C. Considering the fact that heat generation occurs at A1 transformation temperature, it is believed that this specifies the A1 transformation temperature (about 740° C.). In Comparative Example No. 2, the time for the temperature stationary region "Sc" took long, and the cooling rate that passed the A1 transformation temperature was slow; further, the cooling rate after the temperature stationary region "Sc" was extremely slow, and no controlled cooling was carried out. On the contrary, in Test Example No. 2, the time for the temperature stationary region "Se" took short, and the cooling rate that passed the A1 transformation temperature was fast; further, the cooling rate after the temperature stationary region "Se" is pretty fast, and controlled cooling was carried out. When measuring their hardness at an identical section, it fell within a range of Hv 170-178 in Comparative Example No. 2. In Test Example No. 2, it fell within a range of Hv 191-211. Since the hardness and the tensile strength correlate with each other, the hardness and tensile strength of the product 27 were superb in Test Example No. 2 in which controlled cooling was carried out. Thus, since the strengthening of texture can be intended by means of controlled cooling even in flaky graphite cast iron, further strengthening of flaky graphite cast iron itself is expected.

(Others) The present invention is not limited to those mentioned above and the embodiments shown in the drawings alone, but can be carried out within ranges, which do not depart from the gist, while making changes properly. In aforementioned Embodiment No. 1, although the melter 1, the mold maker 3, the molten-metal pourer 4, the mold disassembler 5, and the cutter 6 are disposed, it is allowable that no melter and/or cutter can be disposed. When no melter is disposed, molten metal is used, molten metal which has been melted at another location. In aforementioned Embodiment No. 1, as far as the first tearer 55 and second tearer 56 are those which can tear off the sand casting mold 2, they are not limited to those that are formed as a letter—"U" configuration in cross section, and accordingly can also be formed as another configuration, such "C" configurations, "V" configurations and "Y" configurations. It is allowable to do away with the first intermediate cutters 553 in the first tearer 55. Moreover, it is allowable to do away with the second intermediate cutters 563 in the second tearer 56.

In said Embodiment No. 1, it is allowable to adapt it into such a construction that omits the cutter 6 and/or the cast-product cooling device 68. Further, in said Embodiment No. 2, it is allowable as well to dispose a dimensional-accuracy detector for detecting dimensional accuracy of the before-cutting cast product 27 between the conveying device 101 and the cutter 6, thereby carrying out the same control as that for the case of the after-cutting cast product 27, also for the case of the before-cutting cast product 27. Although the cast-product cooling device 68*c* possesses the quencher 68*c* for bringing mist or coolant water into contact with the cast product 27, it is allowable for it not to possess the quencher 68*c*. Being not limited to spheroidal graphite cast iron and flaky graphite cast iron, even caterpillar-shaped graphite cast iron or eutectic graphite cast iron is allowable. Furthermore, even cast iron with hypoeutectic composition, cast iron with eutectic composition, or cast iron with hypereutectic composition is allowable, and it can also be applied to alloy cast iron. In this case, as for the basic composition, the following is exemplified: carbon being 1.0-4.5%; silicon being 0.3-10%; and manganese being 0.05-1.5% by mass %. In spheroidal graphite cast iron, magnesium can be present in a content having been known heretofore. It is possible to grasp the following technical ideas as well from the aforementioned descriptions.

(Additional Term No. 1)

An apparatus for cast-product production line, the apparatus being characterized in that it has the following jointly: a kneader for kneading casting sand for making mold; a mold maker for making a sand casting mold of said casting sand for making mold, the sand casting mold being provided with a molding cavity for forming a singular cast product or plural cast products; a molten-metal pourer for pouring molten metal into said molding cavity of said sand casting mold; a mold disassembler for disassembling said sand casting mold having undergone molten-metal pouring; and a cutter for cut processing said cast product that has been disassembled from said sand casting mold.

(Additional Term No. 2)

An apparatus for cast-product production line, the apparatus being characterized in that it has the following jointly: a kneader for kneading casting sand for making mold; a mold maker for making a sand casting mold from said casting sand for making mold, the sand casting mold being provided with a molding cavity for forming a singular cast product or plural cast products; and a mold disassembler for disassembling said sand casting mold having undergone molten-metal pouring; and being characterized in that, upon disassembling said sand casting mold by said mold disassembler, it is adapted so that said sand casting mold is disassembled in such a state that at least a portion of said cast product is supported by means of a cast-product supporter element.

INDUSTRIAL APPLICABILITY

The present invention can be utilized for an apparatus for production lines for producing iron-based cast products, such as component parts for brake system, component parts for driving system and component parts for internal combustion engine, for instance.

The invention claimed is:

1. A method of making a cast-product, using an apparatus for cast-product production line comprising: a kneader for kneading casting sand for making a mold, the kneader including a first kneader and a second kneader; a mold maker for making a sand casting mold of said casting sand for making the mold, the sand casting mold being provided with a molding cavity for forming a singular cast product or plural cast products, a molten-metal pourer for pouring molten metal into said molding cavity of said sand casting mold; and a mold disassembler for disassembling said sand casting mold having undergone molten-metal pouring, the mold disassembler including a separator configured to take out said singular cast product or said plural cast products from said sand casting mold and separate the casting sand of said sand casting mold, the method comprising:

pouring step of pouring the molten metal into said molding cavity of said sand casting mold in said molten-metal pourer, separating step of disassembling said sand casting mold having undergone molten metal pouring and taking out the singular cast product or the plural cast products from said sand casting mold and separating the casting sand of said casting mold in said mold disassembler, forming step of forming the casting sand for making the mold, said casting sand which is made into a mold by the mold maker, using said casting sand separated from said sand casting mold in said separating step, and mold making step of making the sand casting mold being provided with the molding cavity for forming the singular cast product or the plural cast products using said casting sand, wherein in said separating step, upon disassembling said sand casting mold by said mold disassembler, said sand casting mold is disassembled in such a state that at least a portion of said singular cast product or said plural cast products is supported by means of a cast-product supporter element, and upon separating the casting sand of said sand casting mold in said separator of said mold disassembler, the casting sand of said sand casting mold is separated based on casting sand having a first thermal influence resulting from the molten metal, and casting sand having a second thermal influence resulting from the molten metal, wherein the first thermal influence is larger than the second thermal influence, wherein in said forming step, said first kneader blends and then kneads an additive material for sand with the casting sand, which has been separated by said separator and which was the first thermal influence, thereby recovering said casting sand, and said second kneader blends and then kneads the casting sand, which has been kneaded and then recovered by said first kneader, with the casting sand, that has been separated by said separator and which was the second thermal influence, thereby forming the casting sand that is to be subjected to the mold making by said mold maker, wherein when a blending amount of said additive material for sand, additive material which is blended with per unit mass of said casting sand which was the first thermal influence, is taken as Wa and a blending amount of the additive material for sand, additive material which is blended with per unit mass of said casting sand which was the second thermal influence, is taken as Wb, the blending amount Wa is set greater than the blending amount Wb.

2. The method of making a cast-product according to claim 1, further comprising conveying step of conveying said cast sand for making the mold, which has been formed by said second kneader, directly to said mold maker by a conveyer.

3. The method of making a cast-product according to claim 1, wherein said separating step further comprises:

(i) supporting step of restraining at least a portion of the singular cast product or the plural cast products, which is buried in said sand casting mold after molten-metal pouring with said cast-product supporter element, thereby supporting the portion of the singular cast product or the plural cast products, (ii) tearing step of tearing off an outside part of said sand casting mold, which buries the singular cast product or the plural cast products therein, from the singular cast product or the plural cast products, the tearing off occurring after molten-metal pouring.

4. The method of making a cast-product according to claim 3, wherein said tearing step of tearing off an outside part of said casting mold from the singular cast product or the plural cast products includes moving a first tearer and a second tearer in a direction away from each other.

5. The method of making a cast-product according to claim 3, wherein said supporting step of restraining includes supporting at least one of a sprue port, a sprue runner, a sprue gate and a gas-venting portion of the singular cast product or the plural cast products.

6. The method of making a cast-product according to claim 1, wherein said separating step further comprising a crack generating step of pressing a crack generator into said sand casting mold, which buries the singular cast product or the plural cast products therein, prior to the disassembling of said sand casting mold, thereby generating crack in said sand casting mold, wherein the pressing of the crack generator occurs after molten-metal pouring.

7. The method of making a cast-product according to claim 1, wherein said separating step of starting or/and finishing disassembly of said sand casting mold is performed when a temperature of the singular cast product or the plural cast products is A1 transformation temperature or more.

8. The method of making a cast-product according to claim 1, wherein said separating step of starting or/and finishing disassembly of said sand casting mold is performed when a temperature of the singular cast product or the plural cast products is less than A1 transformation temperature and 450° C. or more.

9. The method of making a cast-product according to claim 1, wherein said separating step further comprises dropping step of dropping sand down from the singular cast product or the plural cast products by projecting shots onto the singular cast product or the plural cast products; and said step of projecting shots is started and/or finished when a temperature of the singular cast product or the plural cast products is A1 transformation temperature or more.

10. The method of making a cast product according to claim 1, further comprising a forming step of forming the molten metal by melting a meltable material.

11. The method of making a cast-product according to claim 1, further comprising a cutting step of cut processing the singular cast product or the plural cast products that has been disassembled from said sand casting mold.

12. The method of making a cast-product according to claim 1, further comprising:

(i) forming step of forming the molten metal by melting a meltable material; and (ii) cutting step of cut processing the singular cast product or the plural cast products that has been disassembled from said sand casting mold.

13. The method of making a cast-product according to claim 11, further comprising (i) detecting step of detecting cutting resistance at a time of cut processing the singular cast product or the plural cast products; and (ii) adjusting step of adjusting at least one of an amount of additive material for molten metal to be added to a meltable material and a type of the additive material for molten metal when abnormality is acknowledged in the cutting resistance being detected in said detecting step.

14. The method of making a cast-product according to claim 11, further comprising (i) detecting step of detecting dimensional accuracy of the singular cast product or the plural cast products before cutting and/or after cutting; and (ii) adjusting step of adjusting casting-mold strength of said sand casting mold with said mold maker when abnormality is acknowledged in the dimensional-accuracy being detected in said detecting step.

15. The method of making a cast-product according to claim 1, further comprising (i) shot-projecting step of projecting shots onto the singular cast product or the plural cast products with a shotting device, which has been taken out of said sand casting mold, thereby dropping sand down therefrom; and (ii) shots altering step of altering projection time of said shots to be projected and/or projection amount thereof to said shotting device depending on properties of the singular cast product or the plural cast products.

16. The method of making a cast-product according to claim 11, further comprising (i) cast-product keeping step of temporarily keeping the singular cast product or the plural cast products, which has been taken out of said sand casting mold; and (ii) cast-product cooling step of facilitating cooling of the singular cast product or the plural cast products, which is cooled in said cast-product keeping step and which is before cutting.

17. The method of making a cast-product according to claim 16, wherein said cast-product cooling step further comprises an adjusting step of adjusting cooling rate of the singular cast product or the plural cast products before cutting, depending on a kept number and/or temperature of the singular cast product or the plural cast products, which are kept in said cast-product keeping step.

18. The method of making a cast-product according to claim 17, wherein said adjusting step further comprises altering step of altering texture of metallic structure of the singular cast product or the plural cast products, which are stored in said cast-product keeping step, depending on the cooling rate of the singular cast product or the plural cast products.

* * * * *